US010446313B2

(12) United States Patent
Kawarai et al.

(10) Patent No.: US 10,446,313 B2
(45) Date of Patent: Oct. 15, 2019

(54) ELECTRONIC COMPONENT

(71) Applicant: SUMIDA CORPORATION, Tokyo (JP)

(72) Inventors: Mitsugu Kawarai, Natori (JP); Satoru Yamada, Natori (JP); Kazuyuki Kikuchi, Natori (JP); Tomohiro Kajiyama, Natori (JP); Juichi Ooki, Natori (JP); Motomi Takahashi, Natori (JP); Tsutomu Otsuka, Natori (JP)

(73) Assignee: SUMIDA CORPORATION (JP)

( * ) Notice: Subject to any disclaimer, the term of this patent is extended or adjusted under 35 U.S.C. 154(b) by 39 days.

(21) Appl. No.: 15/488,864

(22) Filed: Apr. 17, 2017

(65) Prior Publication Data

US 2017/0221623 A1 Aug. 3, 2017

Related U.S. Application Data

(62) Division of application No. 15/049,821, filed on Feb. 22, 2016, now abandoned.

(30) Foreign Application Priority Data

Feb. 23, 2015 (JP) ..... 2015-033415

(51) Int. Cl.
*H01F 27/29* (2006.01)
*H01F 27/24* (2006.01)
(Continued)

(52) U.S. Cl.
CPC ..... *H01F 27/24* (2013.01); *H01F 27/00* (2013.01); *H01F 27/2823* (2013.01); *H01F 27/29* (2013.01)

(58) Field of Classification Search
CPC ..... H01F 27/24; H01F 27/2823; H01F 27/29; H01F 27/2847; H01F 27/292
(Continued)

(56) References Cited

U.S. PATENT DOCUMENTS 3,655,971 A 4/1972 Haas et al.
6,296,699 B1 10/2001 Jin
(Continued)

FOREIGN PATENT DOCUMENTS

CN 104051130 A 9/2014
JP 2001-085232 A 3/2001
WO WO-2015/150274 A1 10/2015

OTHER PUBLICATIONS

Extended European Search Report for EP Application No. 16156895.1, dated Sep. 7, 2016 (8 pages).

*Primary Examiner* — Mang Tin Bik Lian
(74) *Attorney, Agent, or Firm* — Harness, Dickey & Pierce, P.L.C.

(57) ABSTRACT

An electronic component includes; a magnetic-body core having a plate-shaped portion and a core portion which extends from an upper surface of the plate-shaped portion; a winding wire which includes a wound portion wound by a rectangular wire into an Edgewise winding form and two non-wound portions extending from the wound portion to two distal ends, and the core portion is inserted through the wound portion; and a magnetic exterior body which covers at least the wound portion and the core portion. The two non-wound portions are respectively arranged along a bottom surface and at least one of the side surfaces of the plate-shaped portion. Parts of the two non-wound portions arranged along the bottom surface are electrodes.

19 Claims, 31 Drawing Sheets

(51) Int. Cl.
*H01F 27/28* (2006.01)
*H01F 27/00* (2006.01)

(58) Field of Classification Search
USPC ..... 336/83, 212, 192
See application file for complete search history.

(56) References Cited

U.S. PATENT DOCUMENTS 6,759,935 B2 7/2004 Moro et al.
6,922,130 B2 * 7/2005 Okamoto ..... H01F 27/027 336/192
8,723,629 B1 * 5/2014 Liu ..... H01F 27/29 336/83
8,730,001 B2 5/2014 Yoshikawa et al.
9,167,682 B2 10/2015 Kawarai et al.
9,318,251 B2 4/2016 Klesyk et al.
2001/0001895 A1 5/2001 Setiabudi et al.
2003/0218527 A1 11/2003 Okamoto
2006/0038651 A1 2/2006 Mizushima et al.
2007/0216512 A1 9/2007 Sano et al.
2008/0003864 A1 1/2008 Hatakeyama et al.
2008/0036566 A1 2/2008 Klesyk et al.
2009/0231078 A1 9/2009 Watanabe
2010/0259353 A1 10/2010 Saito et al.
2011/0005064 A1 1/2011 Klesyk et al.
2011/0260821 A1 10/2011 Yamada et al.
2012/0188040 A1 7/2012 Ogawa et al.
2013/0027161 A1 1/2013 Urano
2013/0328656 A1 12/2013 Sakamoto
2014/0002227 A1 1/2014 Hsieh et al.
2014/0097921 A1 * 4/2014 Ohtsubo ..... H01F 27/292 336/83
2014/0259640 A1 9/2014 Sakamoto et al.
2014/0266541 A1 9/2014 Sakamoto et al.
2014/0286814 A1 * 9/2014 Kotani ..... C22C 38/00 419/30
2015/0042436 A1 2/2015 Arimitsu et al.
2015/0270064 A1 9/2015 Sakamoto et al.

* cited by examiner

ELECTRONIC COMPONENT

CROSS REFERENCES TO RELATED APPLICATIONS

This application is a divisional of U.S. patent application Ser. No. 15/049,821, filed on Feb. 22, 2016, which claims priority to Japanese Patent Application No. 2015-033415, filed in the Japanese Patent Office on Feb. 23, 2015. The entire contents of the above applications are incorporated herein by reference.

BACKGROUND OF THE INVENTION

Description of the Related Art

For a certain electronic component, a winding wire is assembled onto a core and an exterior body for the winding wire and the core is mold-formed by a magnetic material.

In addition, for a certain electronic component, there is used a winding wire formed by winding a rectangular wire into a double flat form (that is, a wire which is formed into two layers by a Flatwise-Winding method) in which there is provided an electrode terminal formed by a separate member in order to enable a surface mounting thereof and the exterior body is mold-formed in which the end portions of the winding wire are connected to the electrode terminal (for example, see Patent Document 1 (US unexamined patent publication No. 2011/0005064)).

SUMMARY OF THE INVENTION

With regard to the manufacturing method of the surface-mounted electronic component as mentioned above, there is sometimes employed a process for visually confirming (namely, by a visual examination or by an image recognition examination mechanically) a solder fillet formed at a side-surface exposed-portion which is a conductive portion exposed from the bottom surface of the electronic component to the side surface thereof when the electronic component is surface mounted.

The abovementioned electronic component has a substantially rectangular-parallelepiped shape in which side-surface exposed-portions are respectively positioned at a pair of side surfaces counterfaced in the substantially rectangular-parallelepiped shape thereof and connecting portions which stand upright from the bottom surface portion of the electrode terminal are extended parallelly toward the longitudinal directions of the cross sections of the rectangular wires along another pair of side surfaces different from that pair of side surfaces, and the end portions of the rectangular wires are wound around the connecting portions thereof. In this manner, the electrode terminals and the winding wires are connected at the connecting portions arranged along the side surfaces of the electronic component so that the width of the electronic component becomes wide.

In addition, in the abovementioned electronic component, the connecting portions which stand upright from the bottom surface portion of the electrode terminal are extended parallelly toward the longitudinal directions of the cross sections of the rectangular wires, and the end portions of the rectangular wires are wound around the connecting portions thereof. In the abovementioned electronic component, the winding is carried out by a Flatwise winding method and therefore, it is possible to connect the winding wire to the electrode terminal in this manner, but in case of the winding wire wound by an Edgewise winding method, it is difficult to connect the winding wire to the electrode terminal in this manner.

In addition, in the abovementioned electronic component, an electrode terminal formed by a separate member is used so that the cost thereof is increased.

The present invention was invented in view of the aforesaid problems and is addressed to obtain an electronic component which needs less size-increase that is caused by connecting the winding wire made of the rectangular wire to the electrode member.

In addition, the present invention was invented in view of the aforesaid problems and is addressed to obtain an electronic component having an electrode member to which the winding wire of the rectangular wire wound into an Edgewise winding form is connectable.

In addition, the present invention was invented in view of the aforesaid problem and is addressed to obtain an electronic component having a constitution in which it is possible to confirm the solder fillet visually without using an electrode member formed by a separate member.

An electronic component relating to the present invention includes a first side-surface and a second side-surface facing the first side-surface, and further, includes: a magnetic-body core including a plate-shaped portion and a core portion which extends from the upper surface of the plate-shaped portion; a winding wire which includes a wound portion wound by a rectangular wire and two non-wound portions extending from the wound portion up to two distal ends, and of which the core portion is inserted through the wound portion; a magnetic exterior body which covers at least the wound portion and the core portion; a first electrode member including a first side-surface exposed-portion which is exposed along the first side-surface; and a second electrode member including a second side-surface exposed-portion which is exposed along the second side-surface. Then, the first side-surface exposed-portion includes a first connecting portion which extends along the height direction of the first side-surface, and the first connecting portion is connected to one of the non-wound portions. The second side-surface exposed-portion includes a second connecting portion which extends along the height direction of the second side-surface, and the second connecting portion is connected to the other of the non-wound portions.

An electronic component relating to the present invention includes a first side-surface and a second side-surface facing the first side-surface, and further, includes: a magnetic-body core including a plate-shaped portion and a core portion which extends from the upper surface of the plate-shaped portion; a winding wire which includes a wound portion wound by a rectangular wire and two non-wound portions extending from the wound portion up to two distal ends, and of which the core portion is inserted through the wound portion; a magnetic exterior body having a substantially rectangular-parallelepiped shape which covers at least the wound portion and the core portion; a first electrode member including a first side-surface exposed-portion which is exposed along the first side-surface; and a second electrode member including a second side-surface exposed-portion which is exposed along the second side-surface. Then, the first electrode member includes a first connecting portion extending in the height direction of the electronic component at any one corner within the four corners of the bottom surface inside the magnetic exterior body, and the first connecting portion is connected to one of the non-wound portions. The second electrode member includes a second connecting portion extending in the height direction of the electronic component at another corner within the four corners of the bottom surface inside the magnetic exterior body, and the second connecting portion is connected to the other of the non-wound portions.

An electronic component relating to the present invention includes a first side-surface and a second side-surface facing the first side-surface, and further, includes: a magnetic-body core including a plate-shaped portion and a core portion which extends from the upper surface of the plate-shaped portion; a winding wire which includes a wound portion wound by a rectangular wire into an Edgewise winding form and two non-wound portions extending from the wound portion up to two distal ends, of which the core portion is inserted through the wound portion; a magnetic exterior body which covers at least the wound portion and the core portion; a first electrode member including a first side-surface exposed-portion which is exposed along the first side-surface; and a second electrode member including a second side-surface exposed-portion which is exposed along the second side-surface. Then, the first electrode member is connected to one of the non-wound portions, and the second electrode member is connected to the other of the non-wound portions.

An electronic component relating to the present invention includes a bottom surface, a first side-surface and a second side-surface facing the first side-surface, and further, includes: a magnetic-body core including a plate-shaped portion and a core portion which extends from the upper surface of the plate-shaped portion; a winding wire which includes a wound portion wound by a rectangular wire into an Edgewise winding form and two non-wound portions extending from the wound portion up to two distal ends, of which the core portion is inserted through the wound portion; and a magnetic exterior body which covers at least the wound portion and the core portion. Then, the two non-wound portions are respectively arranged along at least one of the bottom surface, the first side-surface and the second side-surface, and the portion arranged along the bottom surface at the two non-wound portions is an electrode.

Effect of the Invention

According to the present invention, it is possible to obtain an electronic component having a constitution in which the winding wire of the rectangular wire is connectable to the electrode member by a saved space.

In addition, according to the present invention, it is possible to obtain an electronic component having an electrode member to which a winding wire wound by an Edgewise winding form is connectable.

In addition, according to the present invention, it is possible to obtain an electronic component having a constitution in which it is possible to confirm the solder fillet visually without using an electrode member formed by a separate member.

DESCRIPTION OF THE PREFERRED EMBODIMENTS

Hereinafter, there will be explained exemplified-embodiments of the present invention based on the drawings.

Exemplified—Embodiment 1

Figure 1:
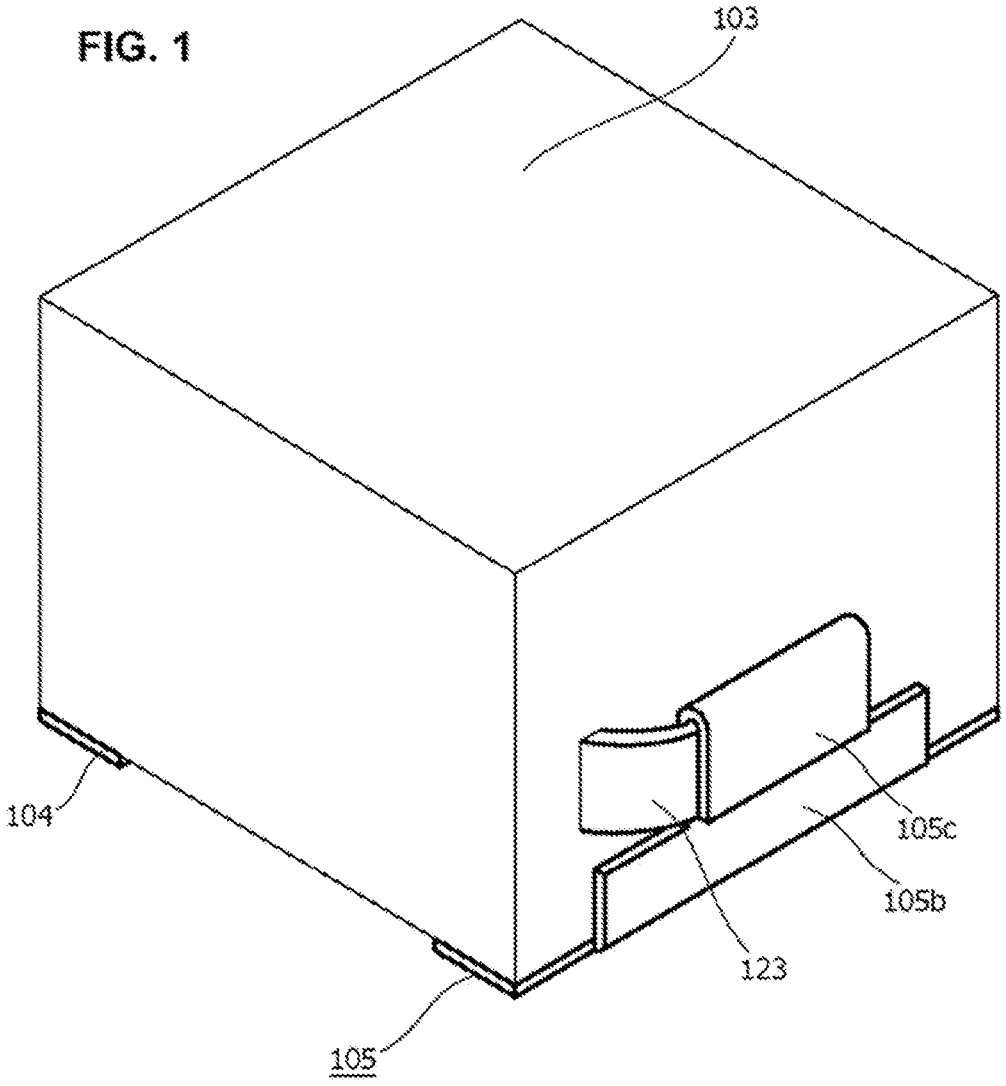
FIG. 1 is a perspective view showing an electronic component relating to an exemplified-embodiment 1 of the present invention (First-Aspect thereof)
Figure 2:
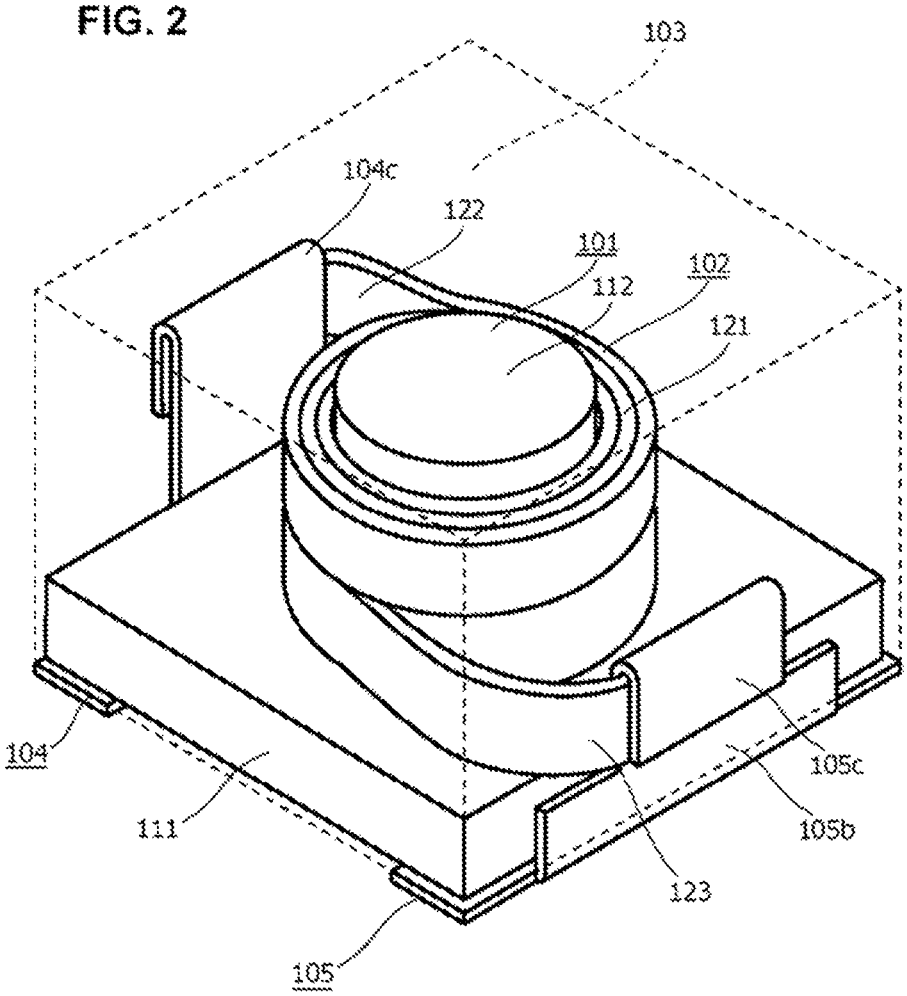
FIG. 2 is a perspective view showing a magnetic-body core, a winding wire and electrode terminals in an electronic component relating to the exemplified-embodiment 1.
Figure 3:
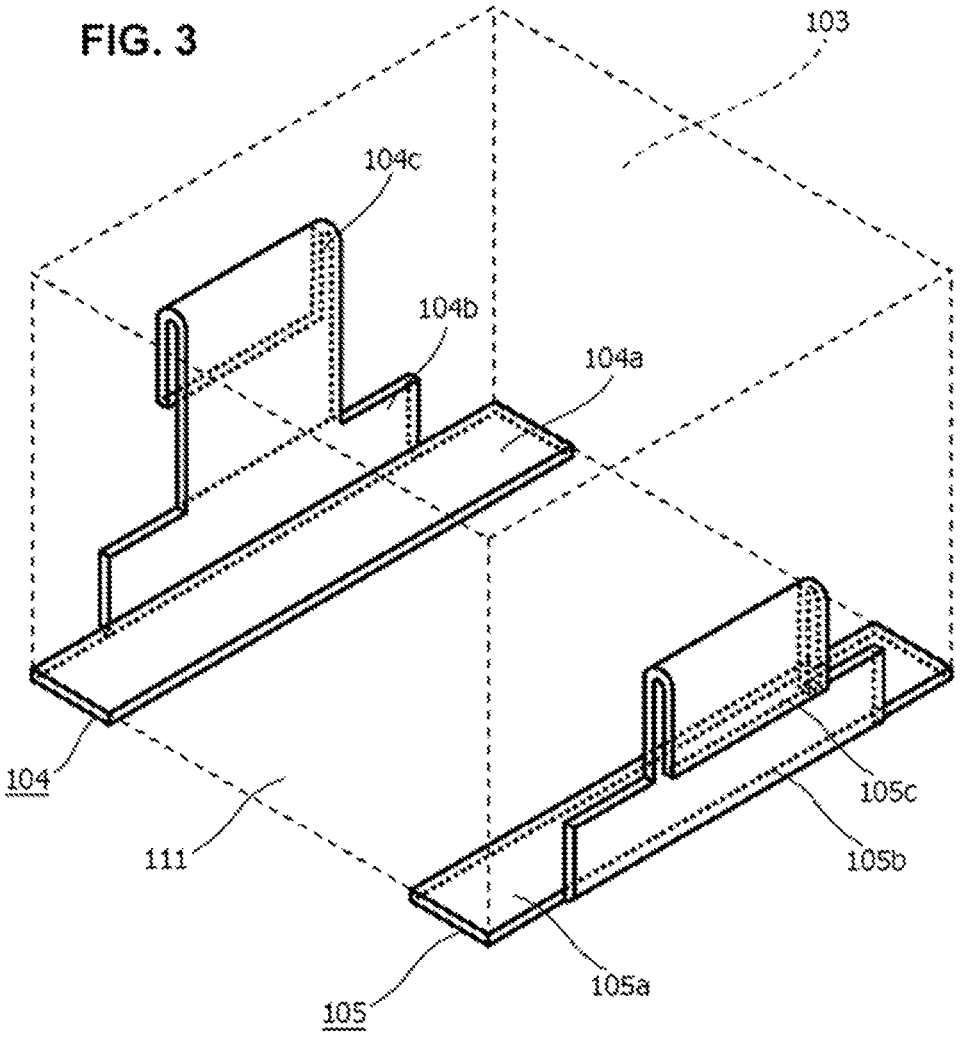
FIG. 3 is a perspective view showing an electronic component relating to the exemplified-embodiment 1 of the present invention (Second-Aspect thereof)

FIG. 1 is a perspective view showing an electronic component relating to an exemplified-embodiment 1 of the present invention (First-Aspect thereof). FIG. 2 is a perspective view showing a magnetic-body core, a winding wire and electrode terminals in an electronic component relating to the exemplified-embodiment 1. FIG. 3 is a perspective view showing an electronic component relating to the exemplified-embodiment 1 of the present invention (Second-Aspect thereof).

It should be noted that illustrations are omitted in the following drawings including FIG. 1, but it is allowed for the edge portions and the corner portions of each member to be chamfered arbitrarily if necessary.

The electronic component shown in FIGS. 1 and 2 is an inductor and includes a magnetic-body core 101, a winding wire 102, a magnetic exterior body 103 and electrode members 104, 105.

The magnetic-body core 101 includes a plate-shaped portion 111 having a substantially rectangular-parallelepiped shape and a core portion 112 having a substantially cylindrical shape which extends upward from the upper surface of the plate-shaped portion 111. It should be noted that it is allowed for the plate-shaped portion 111 and the core portion 112 to be formed integrally as a T-type core or to be formed as separate bodies in which they are connected, for example, by an adhesive agent or through an engagement structure.

In addition, the winding wire 102 includes a wound portion 121 formed by winding a rectangular wire in multiple layers (two layers, here) in a Flatwise winding form and two non-wound portions 122, 123 extending from the wound portion 121 up to the two distal ends thereof. As shown in FIG. 2, the core portion 112 of the magnetic-body core 101 is inserted through the wound portion 121.

For the wound portion 121, the rectangular wire is wound into a Flatwise winding form in which the respective layers are laminated in the direction perpendicular to the winding axis. It should be noted that a Flatwise winding form is a form in which the wide-width surface of the rectangular wire becomes approximately parallel with the winding axis.

It should be noted that it is preferable for the pullout positions of the non-wound portions 122, 123 from the wound portion 121 to be set at the angle positions approximately in the diagonal line direction of the plate-shaped portion 111 centered on the core portion 112 of the magnetic-body core 101. Thus, it is possible to utilize dead spaces in the vicinity of and in the upward directions of the four corners of the plate-shaped portion 111, and as a result thereof, it is possible to reduce the size of the aforesaid electronic component. However, it is allowed for the pullout positions of the non-wound portions 122, 123 from the wound portion 121 to be set at the angle positions in the perpendicular directions with respect to the side surfaces of the plate-shaped portion 111 centered on the core portion 112 of the magnetic-body core 101.

In addition, the magnetic exterior body 103 is a body obtained by molding an admixture including a magnetic material (magnetic powder-body such as ferrite, metal magnetic body or the like) and a resin by a predetermined molding method so as to cover at least the wound portion 121 and the core portion 112.

In the exemplified-embodiment 1, as shown in FIGS. 1 and 2, the magnetic exterior body 103 is formed so as to completely cover the wound portion 121 of the winding wire 102, the core portion 112 of the magnetic-body core 101, and the upper surface and the side surfaces of the plate-shaped portion 111. The magnetic exterior body 103 has an outer shape of substantially rectangular-parallelepiped. By filling and curing the admixture thereof in the inside of the substantially rectangular-parallelepiped thereof, there is formed the magnetic exterior body 103.

It should be noted that it is allowed to employ a configuration in which the magnetic exterior body is to be formed without covering the side surfaces of the magnetic-body core 101. In addition, it is also allowed to employ a configuration in which the magnetic exterior body 103 is formed such that the lower end of the magnetic exterior body 103 will be positioned at a predetermined position in the height direction of the side surface of the magnetic-body core 101 and in which only a portion of the side surfaces of the magnetic-body core 101 is to be exposed.

In addition, the electrode members 104, 105 are formed by a conductive material such as copper or the like. As shown in FIG. 3, the electrode member 104 includes an electrode portion 104*a* and a side-surface exposed-portion 104*b* which stands upright from the electrode portion 104*a*. The side-surface exposed-portion 104*b* is exposed from the magnetic exterior body 103 along one of the two counterfaced side surfaces of the aforesaid electronic component. In addition, the electrode member 105 includes an electrode portion 105*a* and a side-surface exposed-portion 105*b* which stands upright from the electrode portion 105*a*. The side-surface exposed-portion 105*b* is exposed from the magnetic exterior body 103 along one of the two counterfaced side surfaces of the aforesaid electronic component. It should be noted that also the electrode portions 104*a*, 105*a* are exposed from the magnetic exterior body 103.

The electrode member 104 and the electrode member 105 are fixed to the magnetic-body core 101 by an adhesive agent or the like so as to let them face the two counter side surfaces and the bottom surface of the plate-shaped portion 111 of the magnetic-body core 101.

Further, the side-surface exposed-portion 104*b* includes a connecting portion 104*c* extending along the height direction of the side surface thereof and the connecting portion 104*c* is connected to the non-wound portion 122. In addition, the side-surface exposed-portion 105*b* includes a connecting portion 105*c* extending along the height direction of the side surface thereof and the connecting portion 105*c* is connected to the non-wound portion 123.

The distal end of the connecting portion 104*c* is bent approximately 180 degrees so as to wrap the distal end of the non-wound portion 122, and the connecting portion 104*c* and the non-wound portion 122 are mutually connected by pressure bonding, by welding (laser welding, arc welding, supersonic welding or the like and this is all the same hereinafter), by soldering and the like. Similarly, the distal end of the connecting portion 105*c* is bent approximately 180 degrees so as to wrap the distal end of the non-wound portion 123, and the connecting portion 105*c* and the non-wound portion 123 are mutually connected by pressure bonding, by welding, by soldering or the like.

There is a difference between the pullout heights of the non-wound portions 122, 123 and therefore, corresponding to the pullout heights of the non-wound portions 122, 123, the connecting portion 104*c* is connected with the non-wound portion 122 at a position higher than the connecting position between the connecting portion 105*c* and the non-wound portion 123.

It should be noted in this exemplified-embodiment that as shown in FIGS. 1 and 2, the connecting portions 104*c*, 105*c* extend from approximately the centers of the side-surface exposed-portions 104*b*, 105*b*, but it is allowed them to extend from the positions near either end portions apart from the centers of the side-surface exposed-portions 104*b*, 105*b* corresponding to the pullout positions of the non-wound portions 122, 123.

Here, there will be explained one example of a manufacturing method of an electronic component relating to the exemplified-embodiment 1.

Step S1

First, the winding wire 102 is assembled on the core portion 112 of the magnetic-body core 101.

Step S2

Next, the electrode members 104, 105 are fixed on the plate-shaped portion 111 of the magnetic-body core 101.

Step S3

The non-wound portions 122, 123 of the winding wire 102 are led-around to the connecting portions 104*c*, 105*c* of the electrode members 104, 105 and the both sides thereof are connected by welding or the like. At that time, if necessary, it is allowed to cut off unnecessary portions of the non-wound portions 122, 123 or the connecting portions 104*c*, 105*c*.

Step S4

The magnetic-body core 101, the winding wire 102 and the electrode members 104, 105 which are mutually assembled are arranged in the inside of the mold, an admixture including a magnetic material and a resin is filled into the inside of the mold, and the magnetic exterior body 103 is formed by curing the admixture thereof.

In this manner, it is possible to manufacture the electronic component relating to the exemplified-embodiment 1.

Then, when the electronic component relating to the exemplified-embodiment 1 is surface-mounted on a substrate, the electrode portions 104*a*, 105*a* of the electrode members 104, 105 are soldered on the substrate and solder fillets are formed at the side-surface exposed-portions 104*b*, 105*b*.

As described above, according to the aforesaid exemplified-embodiment 1, the winding wire 102 and the electrode terminals 104, 105 are connected on the two side surfaces on which the side-surface exposed-portions 104*b*, 105*b* exist. In this way, it is possible to narrow the width between the remaining two side surfaces on which the side-surface exposed-portions 104*b*, 105*b* do not exist. Therefore, the degree of the size-increase caused by the connection of the winding wire 102 made of the rectangular wire with the electrode members 104, 105 will become less.

Exemplified—Embodiment 2

Figure 4:
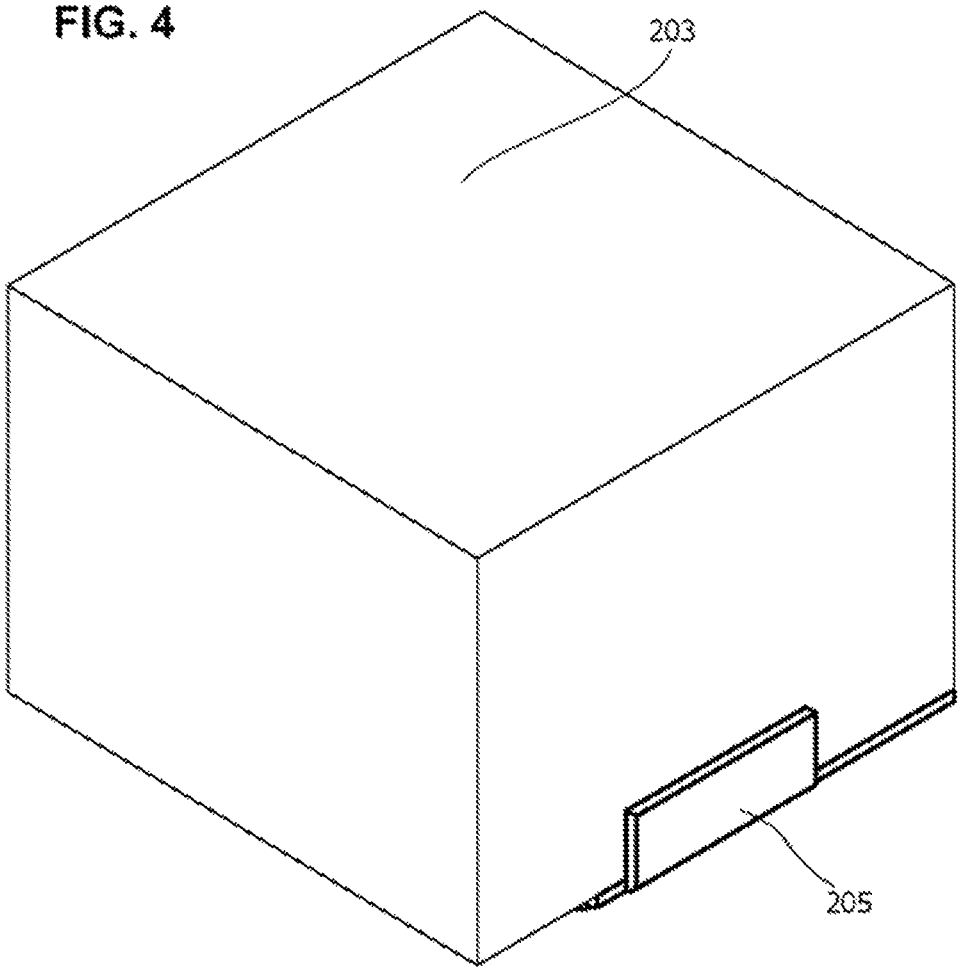
FIG. 4 is a perspective view showing an electronic component relating to the exemplified-embodiment 2 of the present invention.
Figure 5:
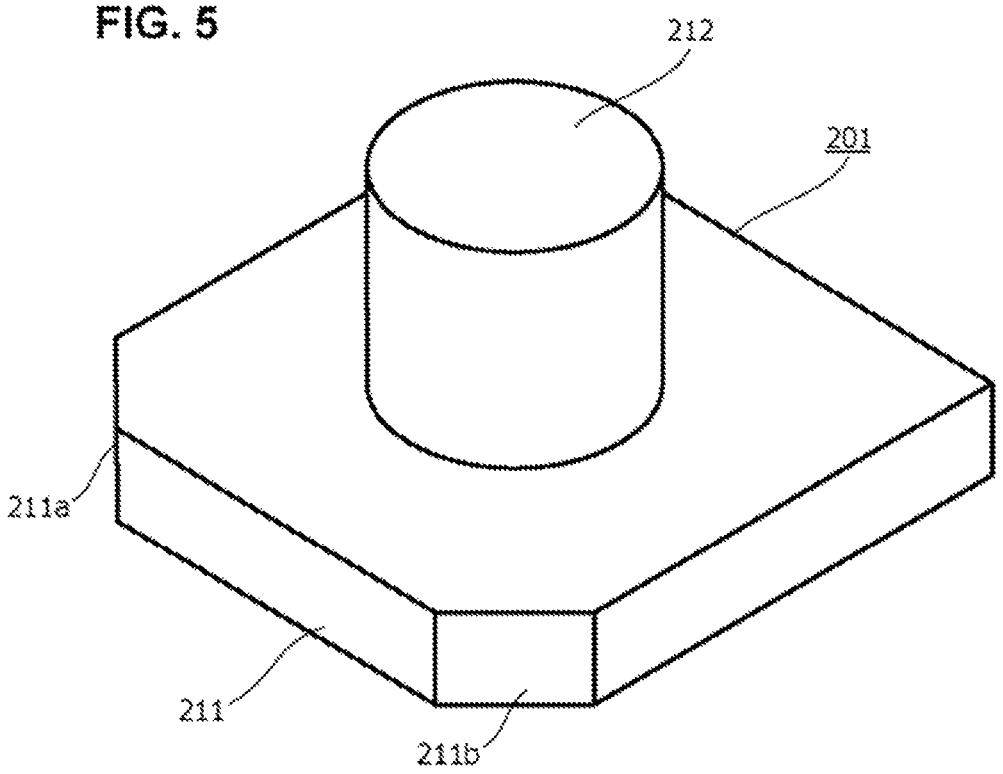
FIG. 5 is a perspective view showing a magnetic-body core in the electronic component relating to the exemplified-embodiment 2 of the present invention.
Figure 6:
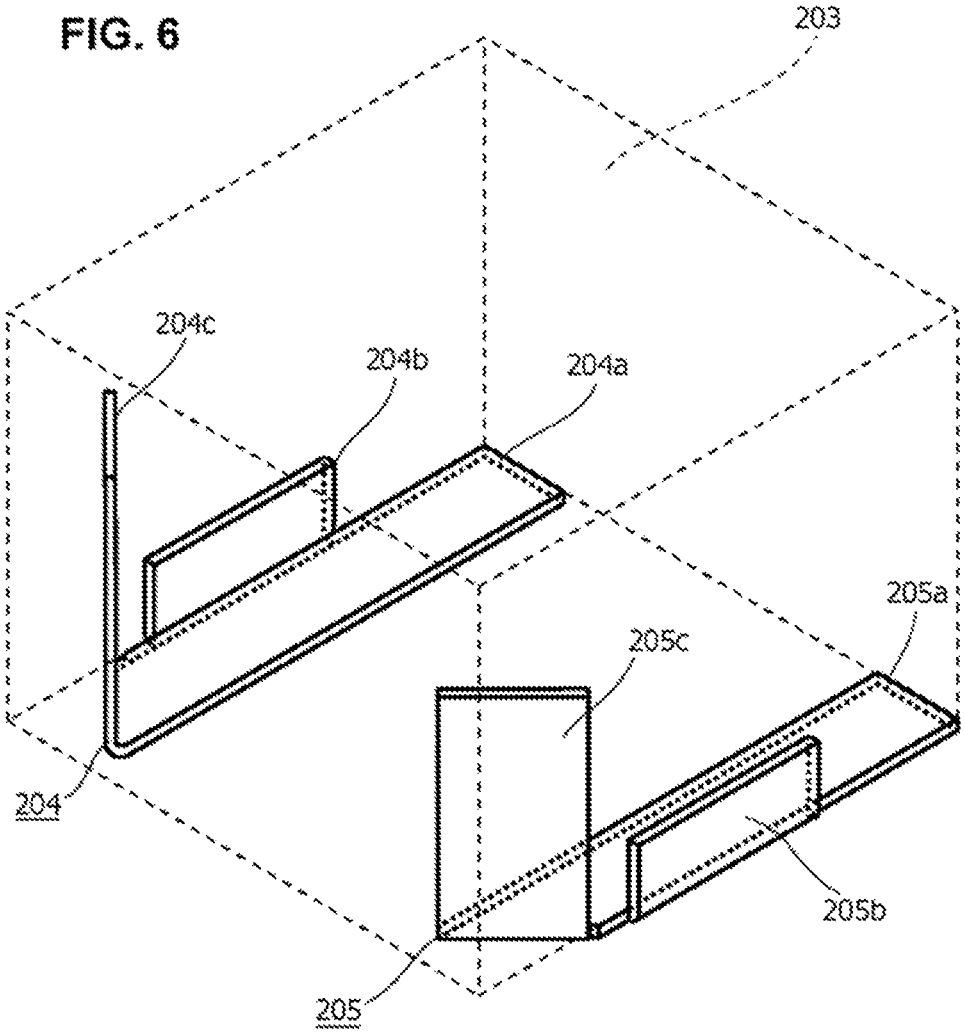
FIG. 6 is a perspective view showing electrode members in the electronic component relating to the exemplified-embodiment 2 of the present invention.

FIG. 4 is a perspective view showing an electronic component relating to the exemplified-embodiment 2 of the present invention. FIG. 5 is a perspective view showing a magnetic-body core in the electronic component relating to the exemplified-embodiment 2 of the present invention. FIG. 6 is a perspective view showing electrode members in the electronic component relating to the exemplified-embodiment 2 of the present invention.

The electronic component relating to the exemplified-embodiment 2 is an inductor and includes a magnetic-body core 201, a winding wire similar to the winding wire 102 in the exemplified-embodiment 1, a magnetic exterior body 203 similar to the magnetic exterior body 103 in the exemplified-embodiment 1 and electrode members 204, 205.

The magnetic-body core 201 includes a plate-shaped portion 211 having a substantially rectangular-parallelepiped shape and a core portion 212 having a substantially cylindrical shape which extends upward from the upper surface of the plate-shaped portion 211. It should be noted that it is allowed for the plate-shaped portion 211 and the core portion 212 to be formed integrally as a T-type core or to be formed as separate bodies which are combined to form a T-shape one, for example, by an adhesive agent or through an engagement structure.

Then, as shown in FIG. 5, at the mutually adjacent two corner portions of the plate-shaped portion 211, there are formed corner cutoff portions 211*a*, 211*b* which are cut-off by a predetermined angle (for example, by 45 degrees).

In addition, the electrode members 204, 205 are formed by a conductive material such as copper or the like. As shown in FIGS. 4 to 6, the electrode member 204 includes a flat-plate shaped electrode portion 204*a* and a flat-plate shaped side-surface exposed-portion 204*b* which stands upright from the electrode portion 204*a*. The side-surface exposed-portion 204*b* is exposed from the magnetic exterior body 203 along one of the two counterfaced side surfaces of the aforesaid electronic component.

In addition, the electrode member 205 includes a flat-plate shaped electrode portion 205*a* and a flat-plate shaped side-surface exposed-portion 205*b* which stands upright from the electrode portion 205*a*. The side-surface exposed-portion 205*b* is exposed from the magnetic exterior body 203 along the other of the two counterfaced side surfaces of the aforesaid electronic component.

The electrode member 204 and the electrode member 205 are fixed to the magnetic-body core 201 by an adhesive agent or the like so as to be faced to the two facing side surfaces and the bottom surface of the plate-shaped portion 211 of the magnetic-body core 201.

It should be noted that also the electrode portions 204*a*, 205*a* are exposed from the magnetic exterior body 203.

Further, as shown in FIG. 6, the electrode member 204 includes a connecting portion 204*c* separately from the side-surface exposed-portion 204*b*. The connecting portion 204*c* stands upright from the electrode portion 204*a* in the inside of the magnetic exterior body 203 at the position adjacent to any one corner within the four corners of the bottom surface of the magnetic exterior body 203, and extends in the height direction of the aforesaid electronic component. In this exemplified-embodiment, the connecting portion 204*c* extends along the abovementioned corner cutoff portions 211*a*.

Similarly, as shown in FIG. 6, the electrode member 205 includes a connecting portion 205*c* separately from the side-surface exposed-portion 205*b*. The connecting portion 205*c* stands upright from the electrode portion 205*a* in the inside of the magnetic exterior body 203 at the position adjacent to any one corner within the four corners of the bottom surface of the magnetic exterior body 203, and extends in the height direction of the aforesaid electronic component. In this exemplified-embodiment, the connecting portion 205*c* extends along the abovementioned corner cutoff portions 211*b*.

Then, one non-wound portion of the winding wire is connected to the connecting portion 204*c* by pressure bonding, by welding, by soldering or the like, and the other non-wound portion of the winding wire is connected to the connecting portion 205*c*. Therefore, the connecting points between the winding wire and the electrode members 204, 205 are positioned in the inside of the magnetic exterior body 203 and are not exposed toward the outside.

It should be noted that it is allowed to select the shapes of the distal ends of the connecting portions 204*c*, 205*c* to be similar to the distal ends of the connecting portions 104*c*, 105*c* in the exemplified-embodiment 1. That is to say, it is allowed to bend the distal ends of the connecting portions 204*c*, 205*c* so as to wrap the non-wound portions 222, 223.

In addition, it is possible to manufacture the electronic component relating to the exemplified-embodiment 2 by similar procedures as those in the manufacturing method of the electronic component relating to the exemplified-embodiment 1.

Then, when the electronic component relating to the exemplified-embodiment 2 is surface-mounted on a substrate, the electrode portions 204*a*, 205*a* of the electrode members 204, 205 are soldered on the substrate and solder fillets are formed at the side-surface exposed-portions 204*b*, 205*b*.

It should be noted that the abovementioned two corner cutoff portions 211*a*, 211*b* are formed at mutually adjacent two corners, but it is allowed to employ a configuration in which (a) the two corner cutoff portions 211*a*, 211*b* are formed at two corners facing each other on a diagonal line of the plate-shaped portion 211, (b) the two electrode members 204, 205 are formed to have identical shapes in conformity with those corner cutoff portions, and (c) the non-wound portions 122, 123 are pulled out from the wound portion 121 in conformity with the two corner cutoff portions thereof and are connected to the connecting portions 204*c*, 205*c*. In this case, the shapes of the electrode members 204, 205 become identical and therefore, the manufacturing process of the electrode members 204, 205 will become simpler.

As described above, according to the aforesaid exemplified-embodiment 2, the connecting portions 204, 205 are arranged at two corners, within four corners, at which the wound portion 221 of the cylindrical shaped winding wire 202 does not exist and therefore, the degree of the size-increase caused by the connection of the winding wire 202 made of the rectangular wire to the electrode members 204, 205 will become less.

Exemplified—Embodiment 3

Figure 7:
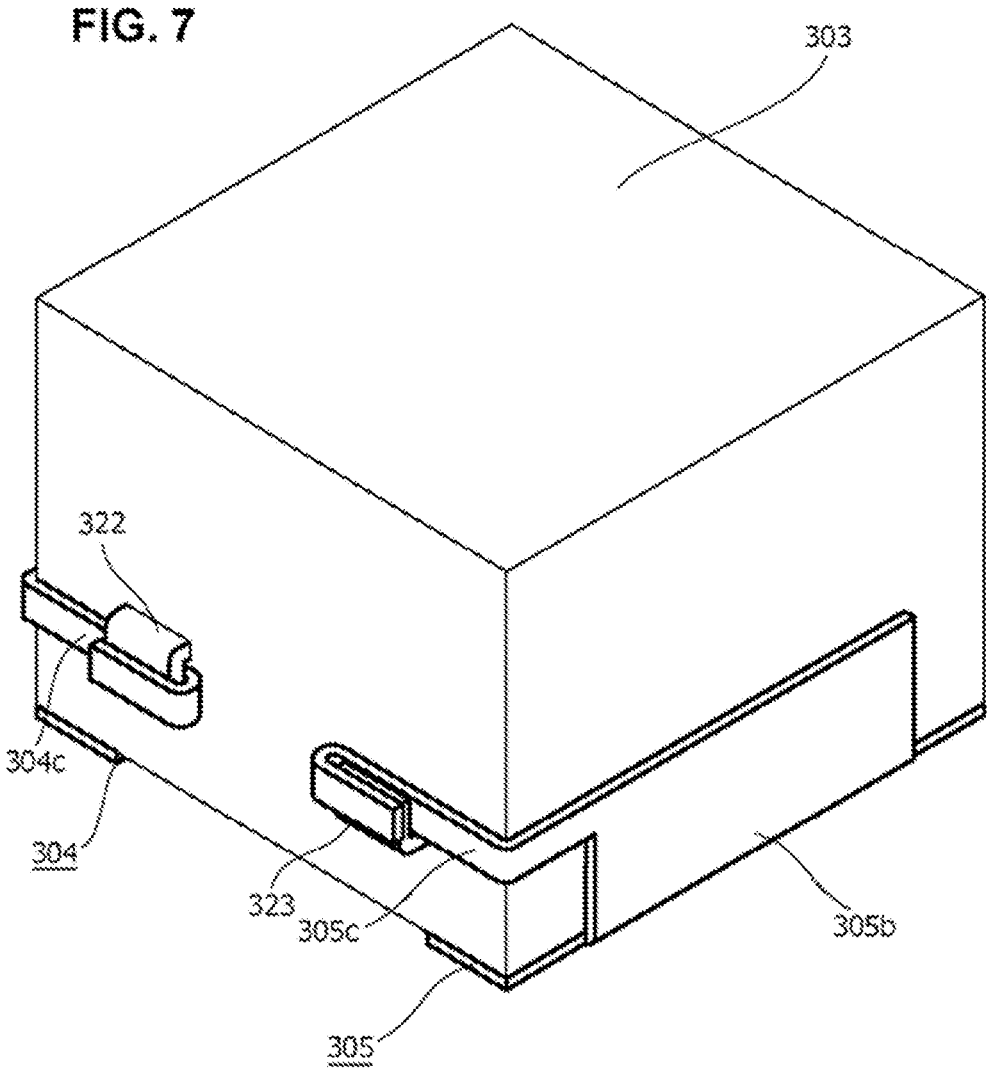
FIG. 7 is a perspective view showing an electronic component relating to an exemplified-embodiment 3 of the present invention.
Figure 8:
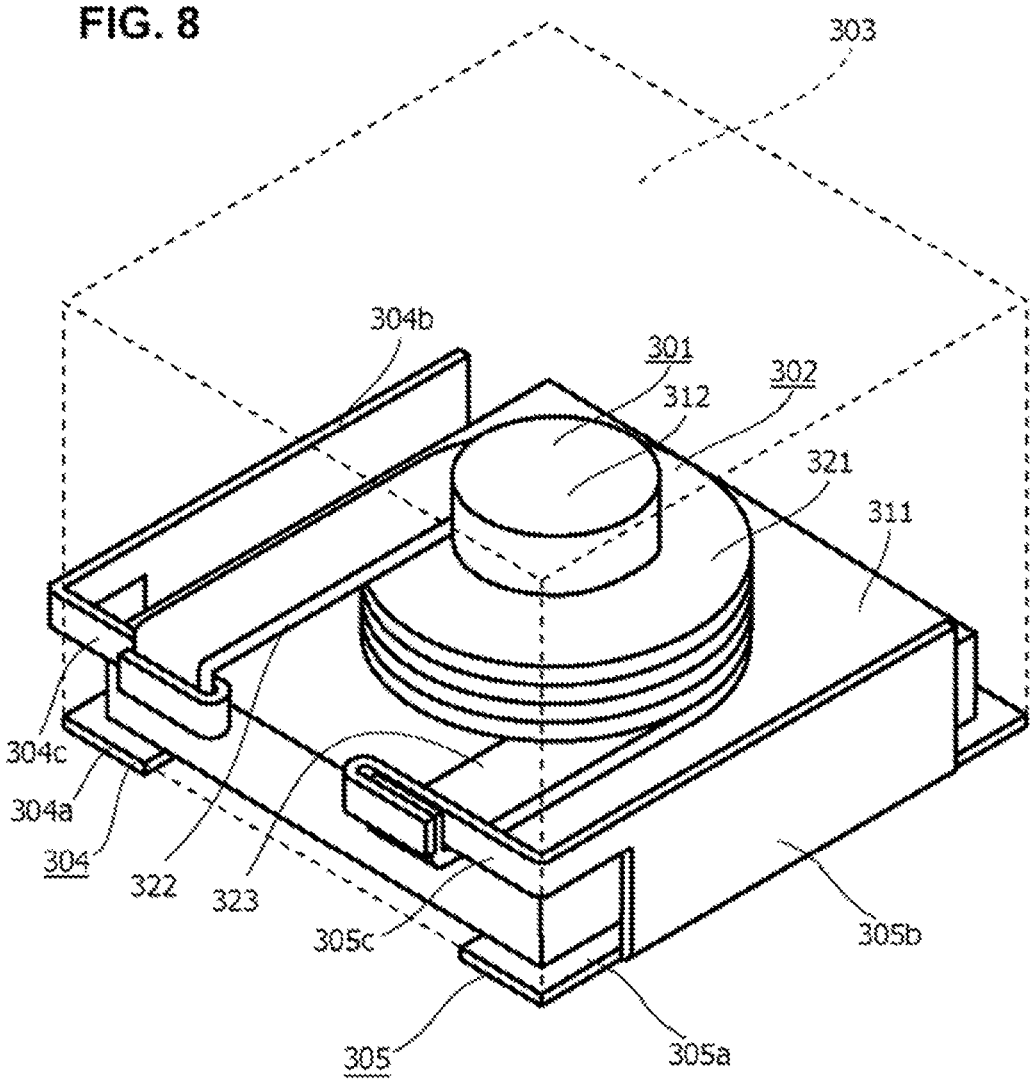
FIG. 8 is a perspective view showing a magnetic-body core, a winding wire and electrode members in the electronic component relating to the exemplified-embodiment 3 of the present invention.
Figure 9:
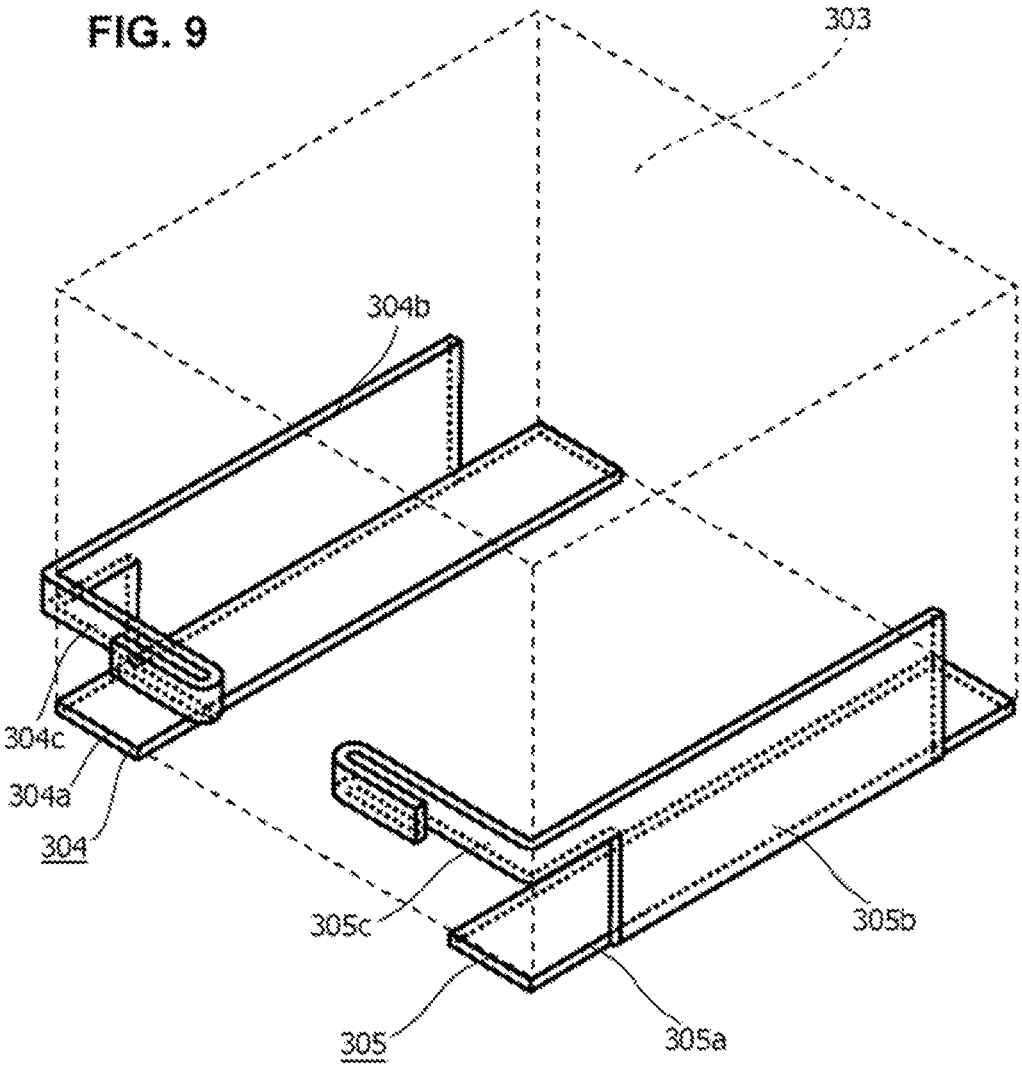
FIG. 9 is a perspective view showing electrode members in the electronic component relating to the exemplified-embodiment 3 of the present invention.

FIG. 7 is a perspective view showing an electronic component relating to an exemplified-embodiment 3 of the present invention. FIG. 8 is a perspective view showing a magnetic-body core, a winding wire and electrode members in the electronic component relating to the exemplified-embodiment 3 of the present invention. FIG. 9 is a perspective view showing electrode members in the electronic component relating to the exemplified-embodiment 3 of the present invention.

The electronic component shown in FIGS. 7 to 9 is an inductor and includes a magnetic-body core 301, a winding wire 302, a magnetic exterior body 303 similar to the magnetic exterior bodies 103, 203 in the exemplified-embodiments 1, 2 and electrode members 304, 305.

The magnetic-body core 301 includes a plate-shaped portion 311 having a substantially rectangular-parallelepiped shape and a core portion 312 having a substantially cylindrical shape which extends upward from the upper surface of the plate-shaped portion 311. It should be noted that it is allowed for the plate-shaped portion 311 and the core portion 312 to be formed integrally as a T-type core or to be formed as separate bodies which are combined together to form a T-shape one, for example, by an adhesive agent or through an engagement structure.

In addition, the winding wire 302 includes a wound portion 321 by winding a rectangular wire into an Edgewise winding form and two non-wound portions 322, 323 extending from the wound portion 321 up to two distal ends thereof. As shown in FIG. 8, the core portion 312 of the magnetic-body core 301 is inserted through the wound portion 321.

For the wound portion 321, the rectangular wire is wound into an Edgewise winding form so as to be laminated in a spiral shape along a winding axis. It should be noted that the Edgewise winding form is a technique to apply the winding such that the wide-width surface of the rectangular wire will become approximately perpendicularly to the winding axis.

For this reason, the pullout height positions of the non-wound portions 322, 323 from the wound portion 321 are different from each other.

In addition, the electrode members 304, 305 are formed by a conductive material such as copper or the like. As shown in FIGS. 7 to 9, the electrode member 304 includes a flat-plate shaped electrode portion 304*a* and a flat-plate shaped side-surface exposed-portion 304*b* which stands upright from the electrode portion 304*a*. The side-surface exposed-portion 304*b* is exposed from the magnetic exterior body 303 along one of the two counterfaced side surfaces of the aforesaid electronic component. In addition, the electrode member 305 includes a flat-plate shaped electrode portion 305*a* and a flat-plate shaped side-surface exposed-portion 305*b* which stands upright from the electrode portion 305*a*. The side-surface exposed-portion 305*b* is exposed from the magnetic exterior body 303 along the other of the two counterfaced side surfaces of the aforesaid electronic component. It should be noted that also the electrode portions 304*a*, 305*a* are exposed from the magnetic exterior body 303.

The electrode member 304 and the electrode member 305 are fixed to the magnetic-body core 301 by an adhesive agent or the like so as to let them face the two counterfaced side surfaces and the bottom surface of the plate-shaped portion 311 of the magnetic-body core 301.

Further, the side-surface exposed-portion 304*b* includes a connecting portion 304*c* extending approximately perpendicularly with respect to the height direction (that is, approximately parallelly with respect to the bottom surface) along the side surface of the magnetic exterior body 302. In addition, the side-surface exposed-portion 305*b* includes a connecting portion 305*c* extending approximately perpendicularly with respect to the height direction (that is, approximately parallelly with respect to the bottom surface) along the side surface of the magnetic exterior body 302. Then, the connecting portions 304*c*, 305*c* are bent at the respective edges of the side surfaces and extend toward the side surface different from the two side surfaces on which the side-surface exposed-portions 304*b*, 305*b* are arranged. Then, the distal portion of the connecting portion 304*c* is connected with the non-wound portion 322 and the distal portion of the connecting portion 305*c* is connected with the non-wound portion 323.

The distal end of the non-wound portion 322 is bent toward the bottom-surface direction of the aforesaid electronic component, the distal end of the connecting portion 304*c* is bent approximately 180 degrees so as to wrap the distal end of the non-wound portion 322, and the connecting portion 304*c* and the non-wound portion 322 are mutually connected by pressure bonding, by welding, by soldering and the like. The distal end of the non-wound portion 323 is bent toward the upper-surface direction of the aforesaid electronic component, the distal end of the connecting portion 305*c* is bent approximately 180 degrees so as to wrap the distal end of the non-wound portion 323, and the connecting portion 305*c* and the non-wound portion 323 are mutually connected by pressure bonding, by welding, by soldering and the like.

It should be noted that it is possible to manufacture the electronic component relating to the exemplified-embodiment 3 by similar procedures as those in the manufacturing method of the electronic component relating to the exemplified-embodiment 1.

In this exemplified-embodiment, as shown in FIG. 7, the connecting points between the connecting portions 304*c*, 305*c* and the non-wound portions 322, 323 are exposed, but it is allowed to employ such a configuration in which the connecting portions are sealed in the inside of the magnetic exterior body 303.

Then, when the electronic component relating to the exemplified-embodiment 3 is surface-mounted on a substrate, the electrode portions 304*a*, 305*a* of the electrode members 304, 305 are soldered on the substrate and solder fillets are formed at the side-surface exposed-portions 304*b*, 305*b*.

As described above, according to the aforesaid exemplified-embodiment 3, the non-wound portions 322, 323 of the winding wire 302 are extended approximately in parallel toward a side surface on which the side-surface exposed-portions 304*b*, 305*b* of the aforesaid electronic component do not exist, are bent on the side surfaces thereof and are connected to the electrode members 304, 305, so that the winding wire 302 which is a rectangular wire wound into an Edgewise winding form is connected to the electrode members 304, 305 without being twisted.

In addition, according to the aforesaid exemplified-embodiment 3, there is employed a configuration in which the non-wound portions 322, 323 of the winding wire 302 are extended approximately in parallel toward a side surface and even though both the positions thereof in the height direction are different, the non-wound portions 322, 323 are connected to the electrode members 304, 305 in identical heights by bending the distal end of the non-wound portion 322 toward the downward direction and by bending the distal end of the non-wound portion 323 toward the upward direction. For this reason, it is possible for the shapes of the electrode members 304, 305 to be symmetrical in the right and left direction and when creating the electrode members 304, 305 by bending plate-shaped members, it is possible to create the electrode members 304, 305 by two plate-shaped members having identical shapes. In this way, it is enough if designing a single shape for designing the electrode terminals 304, 305 and therefore, it is possible to shorten the designing time.

Exemplified—Embodiment 4

Figure 10:
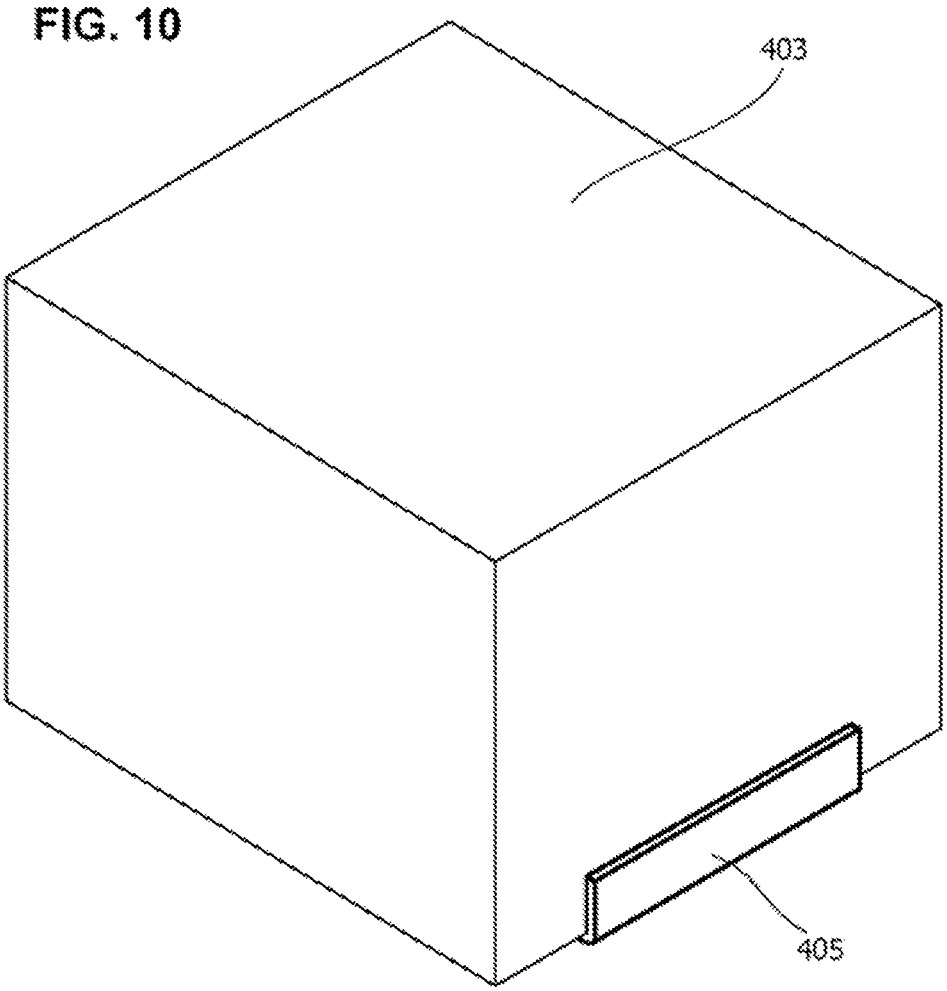
FIG. 10 is a perspective view showing an electronic component relating to an exemplified-embodiment 4 of the present invention.
Figure 11:
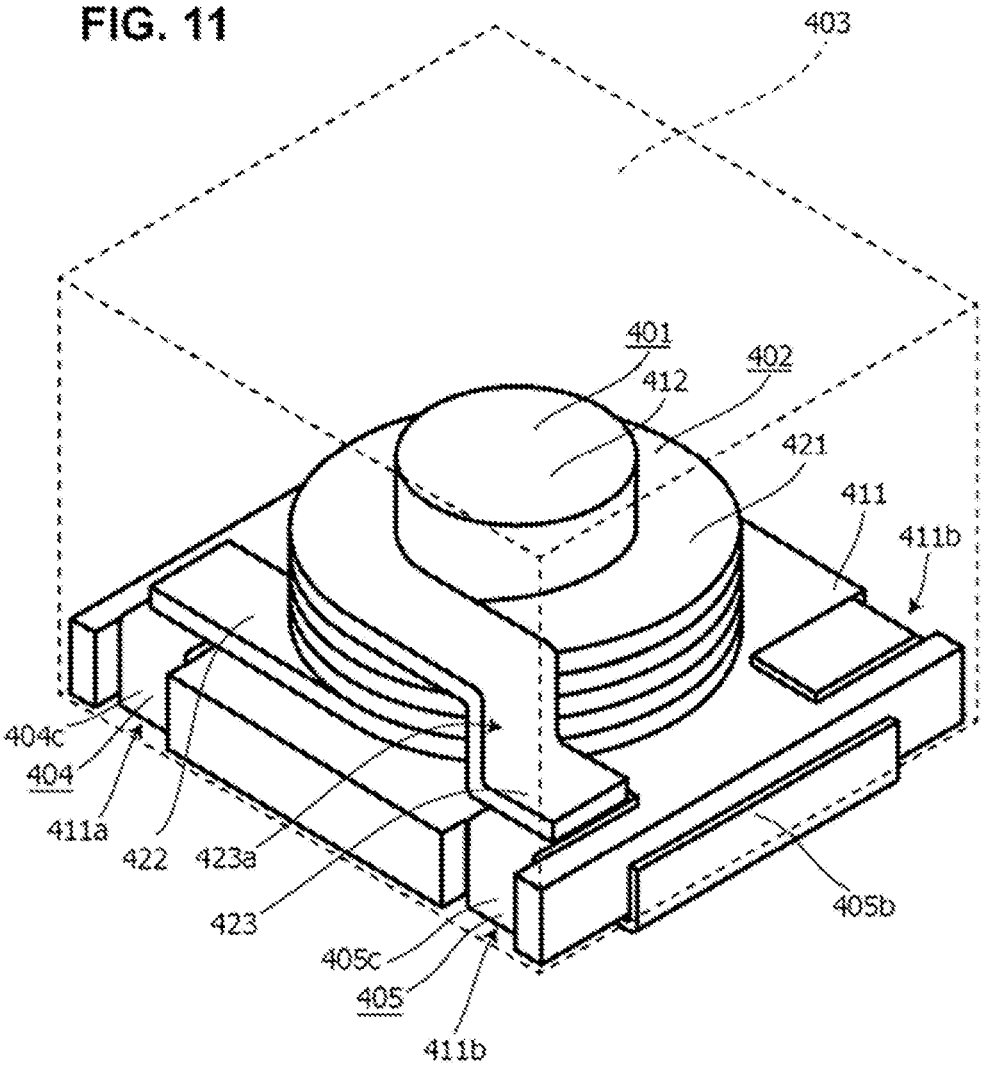
FIG. 11 is a perspective view showing a magnetic-body core, a winding wire and electrode members in the electronic component relating to the exemplified-embodiment 4 of the present invention.
Figure 12:
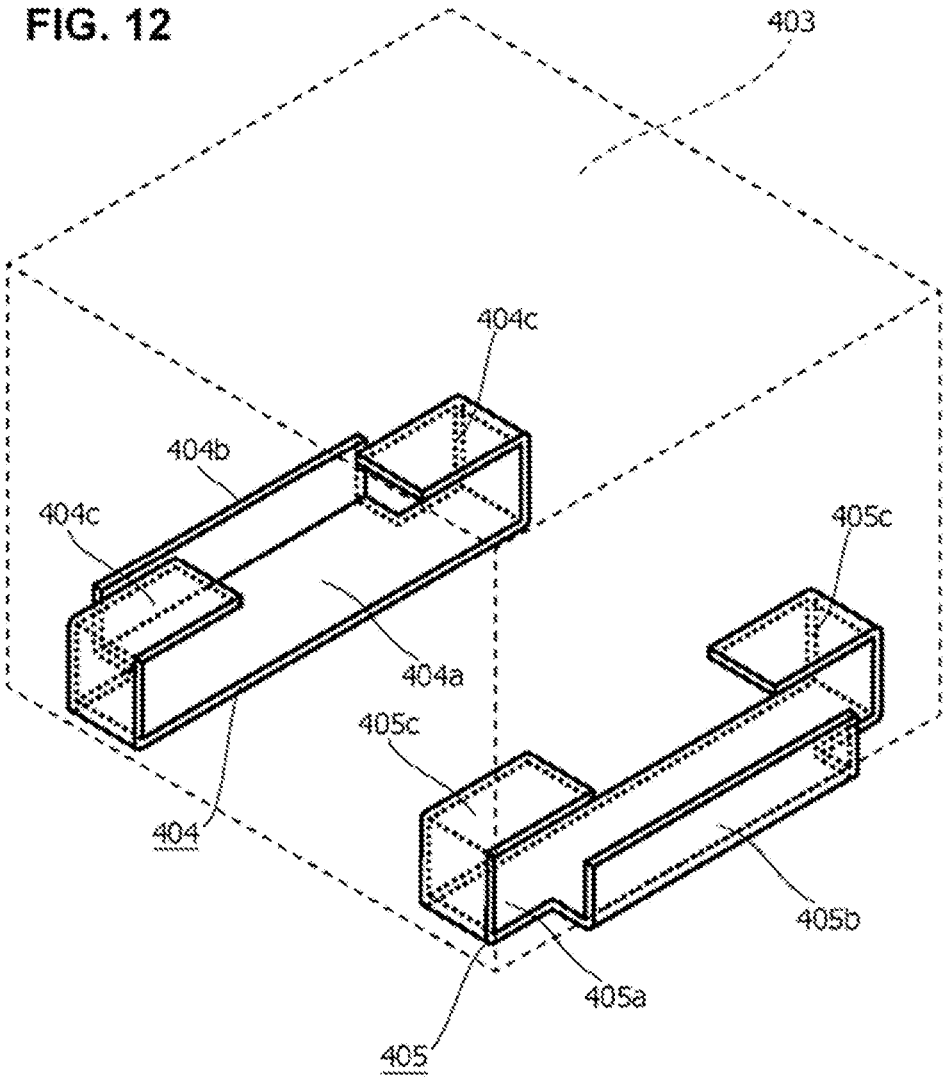
FIG. 12 is a perspective view showing electrode members in the electronic component relating to the exemplified-embodiment 4 of the present invention.

FIG. 10 is a perspective view showing an electronic component relating to an exemplified-embodiment 4 of the present invention. FIG. 11 is a perspective view showing a magnetic-body core, a winding wire and electrode members in the electronic component relating to the exemplified-embodiment 4 of the present invention. FIG. 12 is a perspective view showing electrode members in the electronic component relating to the exemplified-embodiment 4 of the present invention.

The electronic component shown in FIGS. 10 to 12 is an inductor and includes a magnetic-body core 401, a winding wire 402, a magnetic exterior body 403 similar to the magnetic exterior bodies 103, 203, 303 in the exemplified-embodiments 1 to 3 and electrode members 404, 405.

The magnetic-body core 401 includes a plate-shaped portion 411 having a substantially rectangular-parallelepiped shape and a core portion 412 having a substantially cylindrical shape which extends upward from the upper surface of the plate-shaped portion 411. It should be noted that it is allowed for the plate-shaped portion 411 and the core portion 412 to be formed integrally as a T-type core or to be formed as separate bodies which are combined together to form a T-shape one, for example, by an adhesive agent or through an engagement structure.

Further, as shown in FIG. 11, for the two facing side surfaces of the magnetic-body core 401, there are formed concave portions 411*a*, 411*b* having predetermined widths and predetermined depths.

In addition, the winding wire 402 includes a wound portion 421 by winding a rectangular wire into an Edgewise winding form and two non-wound portions 422, 423 extending from the wound portion 421 up to two distal ends thereof. As shown in FIG. 11, the core portion 412 of the magnetic-body core 401 is inserted through the wound portion 421.

In addition, the electrode members 404, 405 are formed by a conductive material such as copper or the like. As shown in FIGS. 10 to 12, the electrode member 404 includes a flat-plate shaped electrode portion 404*a* and a flat-plate shaped side-surface exposed-portion 404*b* which stands upright from the electrode portion 404*a*. The side-surface exposed-portion 404*b* is exposed from the magnetic exterior body 403 along one of the two counterfaced side surfaces of the aforesaid electronic component. In addition, the electrode member 405 includes a flat-plate shaped electrode portion 405*a* and a flat-plate shaped side-surface exposed-portion 405*b* which stands upright from the electrode portion 405*a*. The side-surface exposed-portion 405*b* is exposed from the magnetic exterior body 403 along the other of the two counterfaced side surfaces of the aforesaid electronic component. It should be noted that also the electrode portions 404*a*, 405*a* are exposed from the magnetic exterior body 403.

The electrode member 404 and the electrode member 405 are fixed to the magnetic-body core 401 by an adhesive agent or the like so as to let them face the two counterfaced side surfaces and the bottom surface of the plate-shaped portion 411 of the magnetic-body core 401.

Further, the side-surface exposed-portion 404*b* includes a pair of concave portions 411*a* of the plate-shaped portion 411 of the magnetic-body core 401 and a connecting portion 404*c* extended along the upper surface by being bent, and on the upper surface of the plate-shaped portion 411, the connecting portion 404*c* is connected with the non-wound portion 422. In addition, the side-surface exposed-portion 405*b* includes a pair of concave portions 411*b* of the plate-shaped portion 411 of the magnetic-body core 401 and a connecting portion 405*c* extended along the upper surface by being bent. The non-wound portion 423 is extended toward the direction different by approximately 180 degrees with respect to the non-wound portion 422, includes a step portion 423*a* and is connected to the connecting portion 405*c* on the upper surface of the plate-shaped portion 411. The step portion 423*a* is provided in order to arrange the distal end of the non-wound portion 423 (the portion connected to the connecting portion 405*c*) approximately in the same height as the height of the distal portion of the non-wound portion 422 (the portion connected to the connecting portion 404*c*). It should be noted that by pressure bonding, by welding, by soldering and the like, the connecting portion 404*c* and the non-wound portion 422 are mutually connected and the connecting portion 405*c* and the non-wound portion 423 are mutually connected.

It should be noted that it is possible to manufacture the electronic component relating to the exemplified-embodiment 4 by similar procedures as those in the manufacturing method of the electronic component relating to the exemplified-embodiment 1. However, when fixing the electrode members 404, 405 onto the magnetic-body core 401, the connecting portions 404*c*, 405*c* are bent so as to go along the concave portions 411*a*, 411*b* and the upper surface of the plate-shaped portion 411 of the magnetic-body core 401 in which the electrode members 404, 405 grasp the plate-shaped portion 411 respectively. For this reason, it is allowed not to use an adhesive agent or the like for the fixation of the magnetic-body core 401 onto the electrode members 404, 405.

Then, when the electronic component relating to the exemplified-embodiment 4 is surface-mounted on a substrate, the electrode portions 404*a*, 405*a* of the electrode members 404, 405 are soldered on the substrate and solder fillets are formed at the side-surface exposed-portions 404*b*, 405*b*.

As described above, according to the aforesaid exemplified-embodiment 4, the non-wound portions 422, 423 of the winding wire 402 are connected to the connecting portions 404*c*, 405*c* of the electrode members 404, 405 which are arranged along the upper surface of the plate-shaped portion 411 of the magnetic-body core 401 and therefore, the winding wire 402 which is a rectangular wire wound into an Edgewise winding form is connected to the electrode members 404, 405 without being twisted.

In addition, according to the aforesaid exemplified-embodiment 4, the connecting portions 404*c*, 405*c* are bent twice from the bottom surface to the upper surface of the plate-shaped portion 411 along the concave portions 411*a*, 411*b* of the magnetic-body core 401 and therefore, it is difficult for the electrode members 404, 405 to drop out from the magnetic-body core 401.

Exemplified—Embodiment 5

Figure 13:
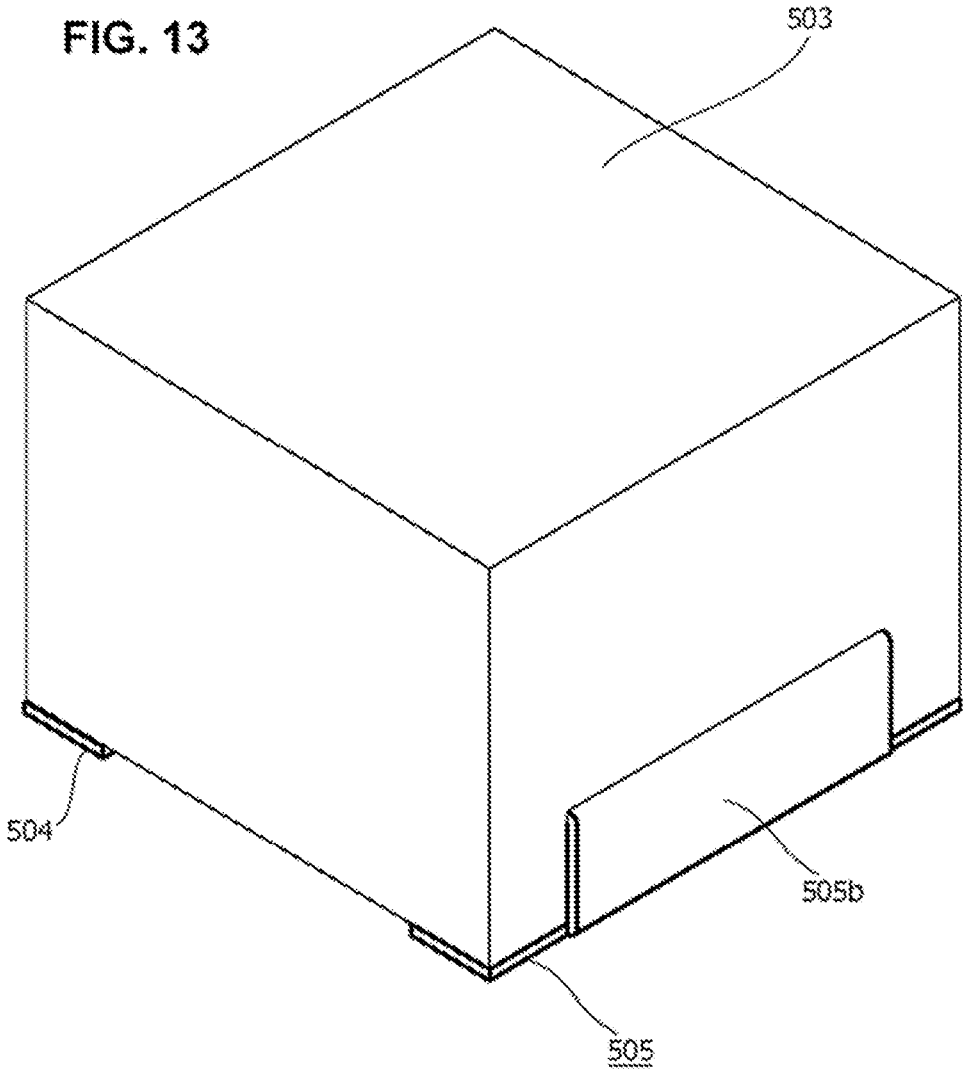
FIG. 13 is a perspective view showing an electronic component relating to an exemplified-embodiment 5 of the present invention.
Figure 14:
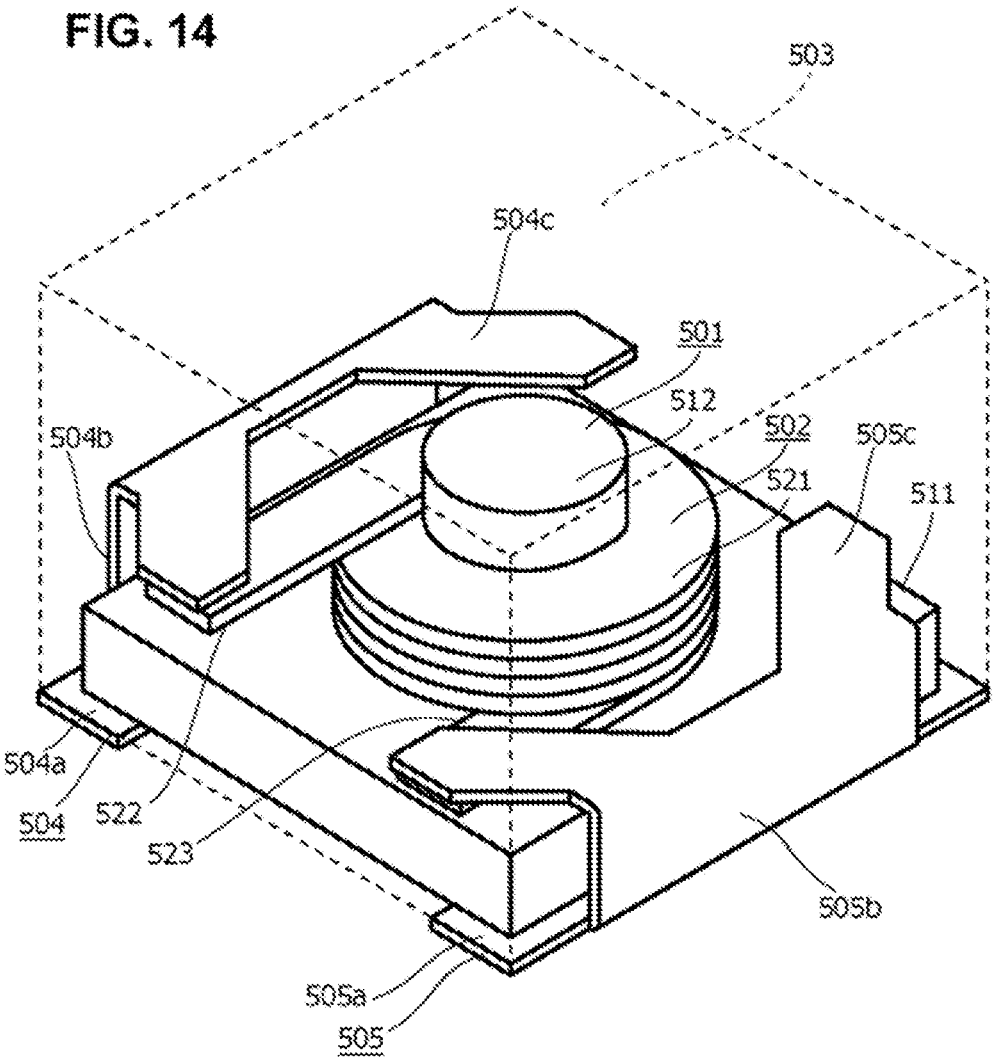
FIG. 14 is a perspective view showing a magnetic-body core, a winding wire and electrode members in the electronic component relating to the exemplified-embodiment 5 of the present invention.
Figure 15:
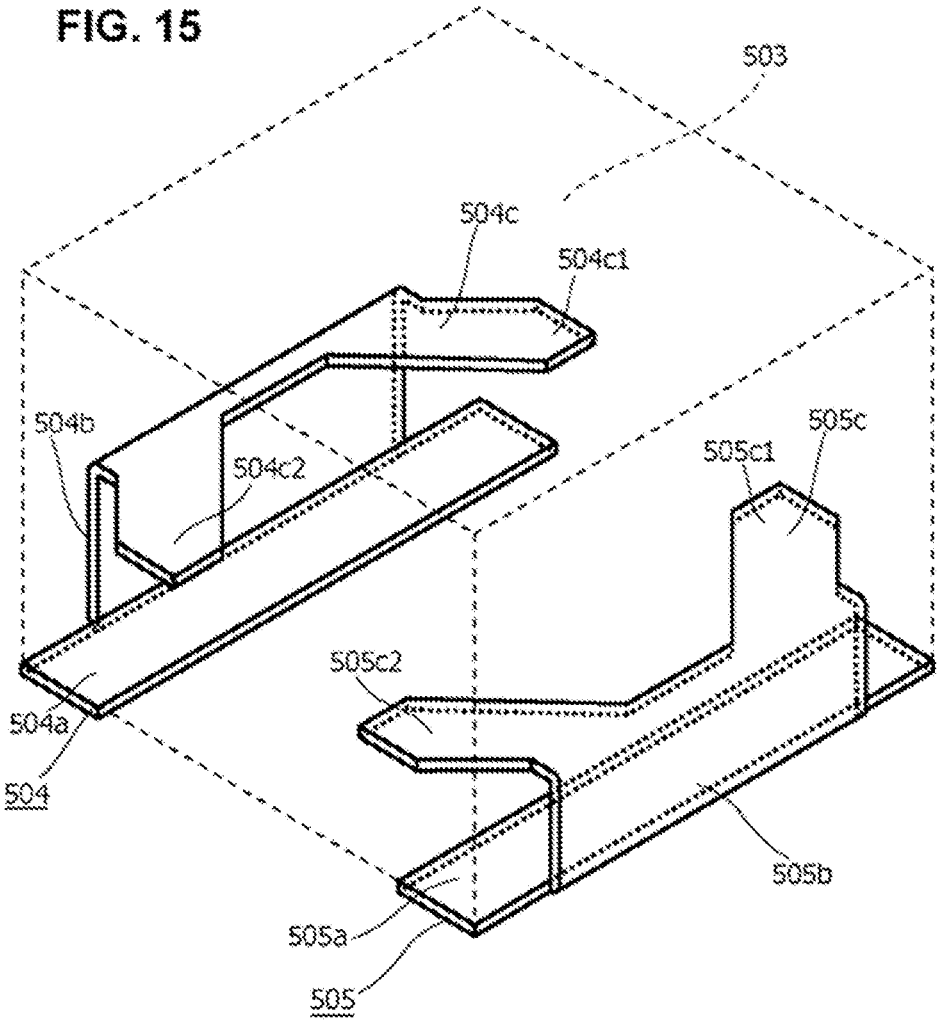
FIG. 15 is a perspective view showing electrode members in the electronic component relating to the exemplified-embodiment 5 of the present invention.

FIG. 13 is a perspective view showing an electronic component relating to an exemplified-embodiment 5 of the present invention. FIG. 14 is a perspective view showing a magnetic-body core, a winding wire and electrode members in the electronic component relating to the exemplified-embodiment 5 of the present invention. FIG. 15 is a perspective view showing electrode members in the electronic component relating to the exemplified-embodiment 5 of the present invention.

The electronic component shown in FIGS. 13 to 15 is an inductor and includes a magnetic-body core 501 similar to the magnetic-body core 301 in the exemplified-embodiment 3; a winding wire 502; a magnetic exterior body 503 similar to the magnetic exterior bodies 103, 203, 303, 304 in the exemplified-embodiments 1 to 4; and electrode members 504, 505.

The winding wire 502 includes a wound portion 521 wound by a rectangular wire into an Edgewise winding form and two non-wound portions 522, 523 extending from the wound portion 521 up to two distal ends thereof. As shown in FIG. 14, the core portion 512 of the magnetic-body core 501 is inserted through the wound portion 521.

In addition, the electrode members 504, 505 are formed by a conductive material such as copper or the like. As shown in FIGS. 13 to 15, the electrode member 504 includes a flat-plate shaped electrode portion 504*a* and a flat-plate shaped side-surface exposed-portion 504*b* which stands upright from the electrode portion 504*a*. The side-surface exposed-portion 504*b* is exposed from the magnetic exterior body 503 along one of the two counterfaced side surfaces of the aforesaid electronic component. In addition, the electrode member 505 includes a flat-plate shaped electrode portion 505*a* and a flat-plate shaped side-surface exposed-portion 505*b* which stands upright from the electrode portion 505*a*. The side-surface exposed-portion 505*b* is exposed from the magnetic exterior body 503 along the other of the two counterfaced side surfaces of the aforesaid electronic component. It should be noted that also the electrode portions 504*a*, 505*a* are exposed from the magnetic exterior body 503.

The electrode member 504 and the electrode member 505 are fixed to the magnetic-body core 501 by an adhesive agent or the like so as to be faced to the two facing side surfaces and the bottom surface of the plate-shaped portion 511 of the magnetic-body core 501.

Further, the side-surface exposed-portion 504*b* includes a connecting portion 504*c* which extends approximately in parallel with the electrode portion 504*a* and the bottom surface of the magnetic-body core 501, and the connecting portion 504*c* is connected with the non-wound portion 522. The height of the electrode member 504 is designed to be in conformity with the position of the non-wound portion 522 in the height direction thereof and the connecting portion

504*c* includes two connecting protruded-portions 504*c*1, 504*c*2 which extend toward two directions by predetermined angles (for example, 45 degrees) centered on the core portion 521, respectively. The non-wound portion 522 is connected to either one of the two connecting protruded-portions 504*c*1, 504*c*2 depending on the number of turns thereof (for example, fraction such as ¼-turn).

In addition, the side-surface exposed-portion 505*b* includes a connecting portion 505*c* which extends approximately in parallel with the electrode portion 505*a* and the connecting portion 505*c* is connected with the non-wound portion 523. The height of the electrode member 505 is designed to be in conformity with the position of the non-wound portion 523 in the height direction thereof and the connecting portion 505*c* includes two connecting protruded-portions 505*c*1, 505*c*2 which extend toward two directions by predetermined angles (for example, 45 degrees) centered on the core portion 521, respectively. The non-wound portion 523 is connected to either one of the two connecting protruded-portions 505*c*1, 505*c*2 depending on the number of turns thereof (for example, fraction such as ¼-turn).

It should be noted that by pressure bonding, by welding, by soldering and the like, the connecting portion 504*c* and the non-wound portion 522 are mutually connected and the connecting portion 505*c* and the non-wound portion 523 are mutually connected.

It should be noted that it is possible to manufacture the electronic component relating to the exemplified-embodiment 5 by similar procedures as those in the manufacturing method of the electronic component relating to the exemplified-embodiment 1.

Then, when the electronic component relating to the exemplified-embodiment 5 is surface-mounted on a substrate, the electrode portions 504*a*, 505*a* of the electrode members 504, 505 are soldered on the substrate and solder fillets are formed at the side-surface exposed-portions 504*b*, 505*b*.

As described above, according to the aforesaid exemplified-embodiment 5, the non-wound portions 522, 523 of the winding wire 502 are connected to the connecting portions 504*c*, 505*c* of the electrode members 504, 505 which are arranged along the upper surface on the upper surface or above the upper surface of the plate-shaped portion 511 of the magnetic-body core 501 and therefore, the winding wire 502 which is a rectangular wire wound into an Edgewise winding form is connected to the electrode members 504, 505 without being twisted.

In addition, by adjusting the height of the electrode member 505 in conformity with the height of the wound portion 521, which corresponds to the number of turns of the winding wire 502, it is possible to connect the non-wound portion 522 to the electrode member 505 and therefore, it is possible to manufacture various kinds of inductance electronic components easily by similar designs.

Further, the connecting portions 504*c*, 505*c* includes two connecting protruded-portions (504*c*1, 504*c*2), (505*c*1, 505*c*2) respectively and therefore, by selecting the connecting protruded-portions which are to be used for the connections, it is possible to fine-adjust the number of turns of the wound portion 521 (that is, the inductance thereof) by less than one turn (for example, ¼-turn).

Exemplified—Embodiment 6

Figure 16:
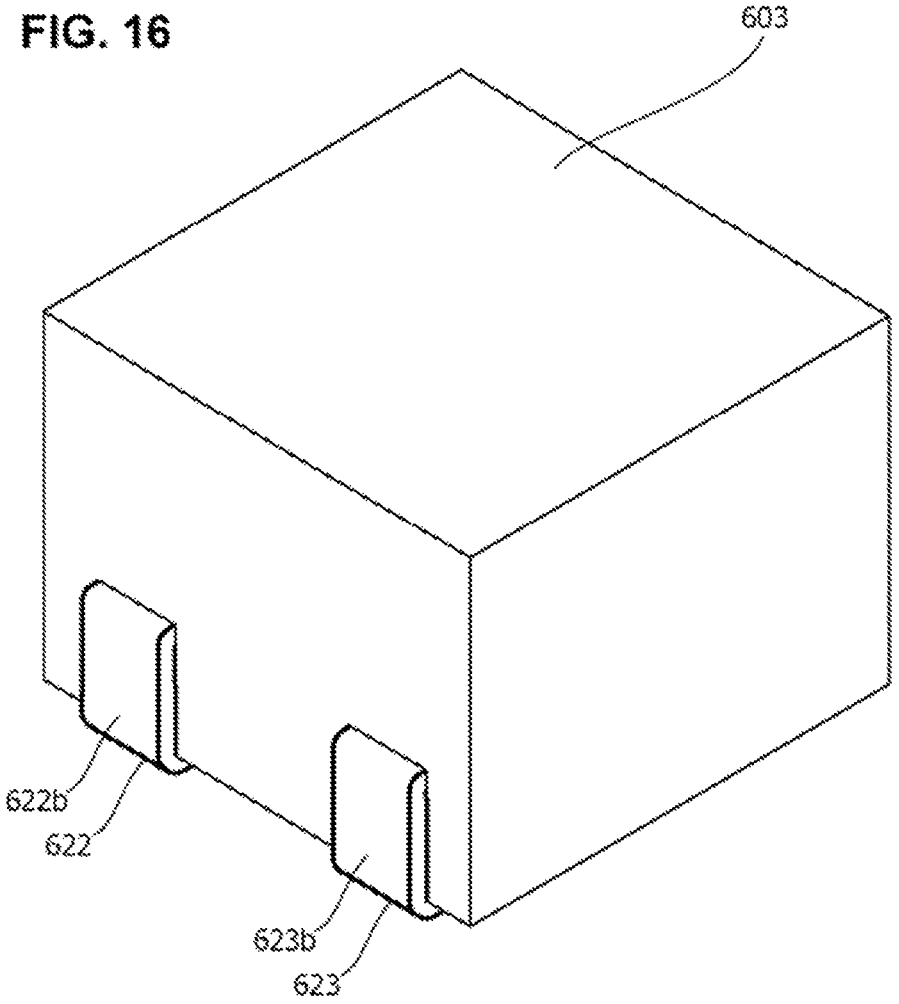
FIG. 16 is a perspective view showing an electronic component relating to an exemplified-embodiment 6 of the present invention (First-Aspect thereof)
Figure 17:
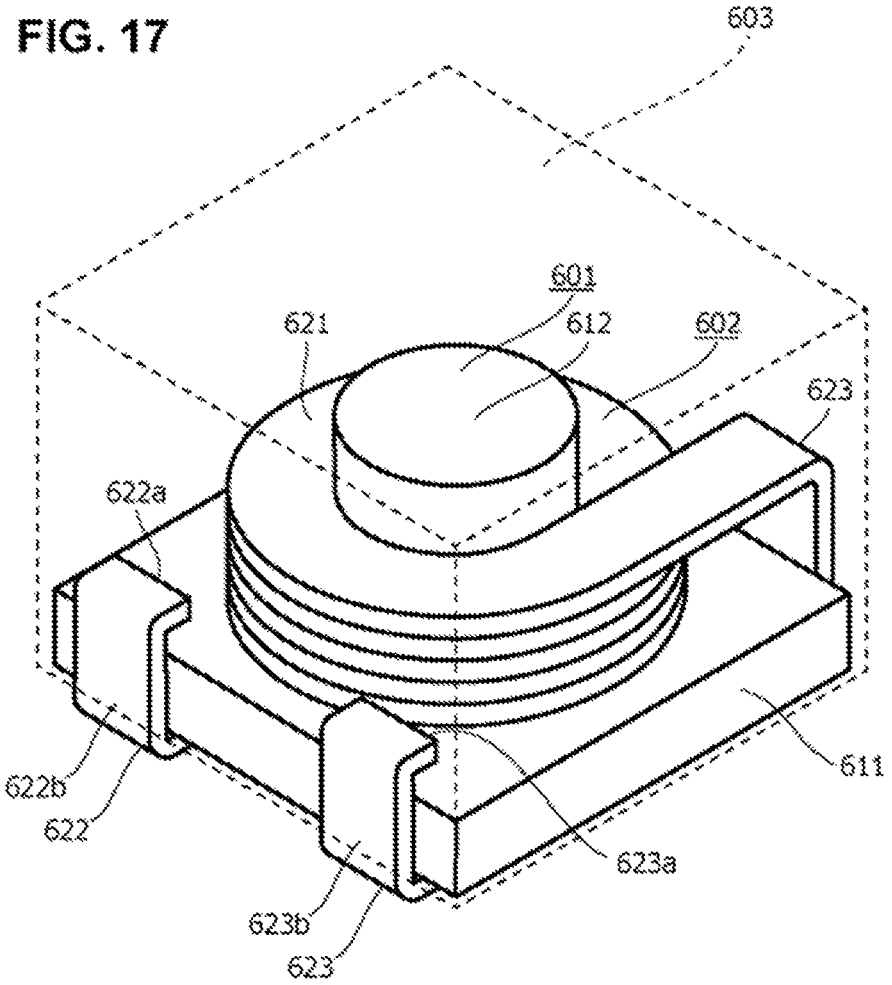
FIG. 17 is a perspective view showing a magnetic-body core and a winding wire in the electronic component relating to the exemplified-embodiment 6.
Figure 18:
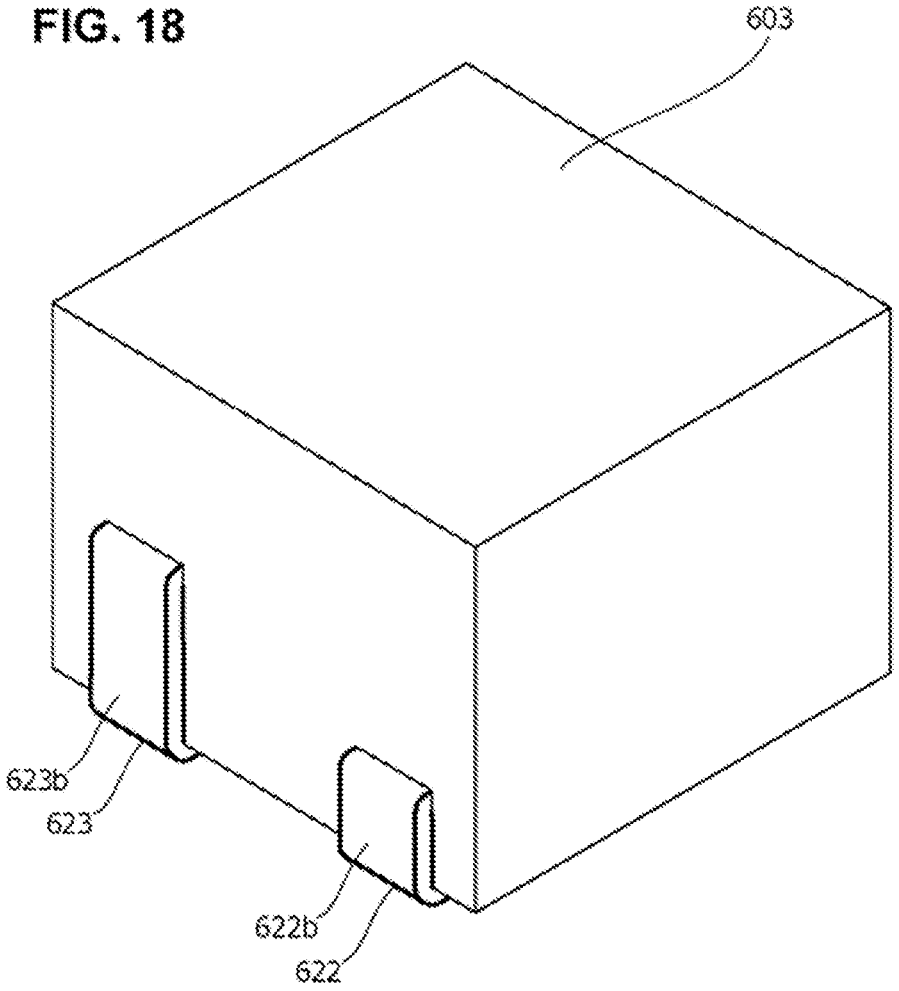
FIG. 18 is a perspective view showing an electronic component relating to the exemplified-embodiment 6 (Second-Aspect thereof)

FIG. 16 is a perspective view showing an electronic component relating to an exemplified-embodiment 6 of the present invention (First-Aspect thereof). FIG. 17 is a perspective view showing a magnetic-body core and a winding wire in the electronic component relating to the exemplified-embodiment 6. FIG. 18 is a perspective view showing an electronic component relating to the exemplified-embodiment 6 (Second-Aspect thereof).

The electronic component shown in FIGS. 16 to 18 is an inductor and includes a magnetic-body core 601, a winding wire 602 and a magnetic exterior body 603.

The magnetic-body core 601 includes a plate-shaped portion 611 having a substantially rectangular-parallelepiped shape and a core portion 612 having a substantially cylindrical shape which extends upward from the upper surface of the plate-shaped portion 611. It should be noted that it is allowed for the plate-shaped portion 611 and the core portion 612 to be formed integrally as a T-type core or to be formed as separate bodies which are combined together to form a T-shape one, for example, by an adhesive agent or through an engagement structure.

In addition, the winding wire 602 includes a wound portion 621 by winding a rectangular wire into an Edgewise winding form and two non-wound portions 622, 623 extending from the wound portion 621 up to two distal ends 622*a*, 623*a* thereof. As shown in FIG. 17, the core portion 612 of the magnetic-body core 601 is inserted through the wound portion 621.

For the wound portion 621, the rectangular wire is wound into an Edgewise winding form in which the layers are laminated in a spiral shape along the winding axis.

Both of the two non-wound portions 622, 623 are arranged approximately in parallel with each other along a first side-surface, a bottom surface (surface facing the upper surface) and a second side-surface facing the first side-surface of the plate-shaped portion 611 of the magnetic-body core 601. In this exemplified-embodiment, the two non-wound portions 622, 623 are formed so as to be extended in the same direction.

Therefore, the two non-wound portions 622, 623 are arranged along the bottom surface of the aforesaid electronic component and along the first side-surface and the second side-surface, respectively. Then, for the two non-wound portions 622, 623, the portions which are arranged along the bottom surface are used for the electrodes.

Further, as shown in FIGS. 16 to 18, while being exposed from the magnetic exterior body 603, the two non-wound portions 622, 623 are bent so as to go along the side surface of the aforesaid electronic component. Further, the distal ends 622*a*, 623*a* of the two non-wound portions 622, 623 are positioned in the inside of the magnetic exterior body 603 and sealed and fixed in the magnetic exterior body 603.

In this manner, as shown in FIGS. 16 and 18, the side-surface exposed-portions 622*b*, 623*b* are formed by the two non-wound portions 622, 623 on the two side surfaces facing each other.

In addition, the magnetic exterior body 603 is a body obtained by molding an admixture including a magnetic material (magnetic-powder body such as ferrite, metal magnetic body or the like) and a resin by a predetermined molding method so as to cover at least the wound portion 621 and the core portion 612.

In the exemplified-embodiment 6, as shown in FIG. 17, the magnetic exterior body 603 is formed so as to completely cover the wound portion 621 of the winding wire 602, the core portion 612 of the magnetic-body core 601, and the upper surface and the side surfaces of the plate-shaped portion 611. The magnetic exterior body 603 has an outer shape of substantially rectangular-parallelepiped. By filling and curing the admixture thereof in the inside of the substantially rectangular-parallelepiped thereof, there is formed the magnetic exterior body 603.

It should be noted that it is allowed to employ a configuration in which the magnetic exterior body is to be formed without covering the side surfaces of the magnetic-body core 601. In addition, it is also allowed to employ a configuration in which the magnetic exterior body 603 is formed such that the lower end of the magnetic exterior body 603 will be positioned at a predetermined position in the height direction of the side surface of the magnetic-body core 601 and in which only a portion of the side surfaces of the magnetic-body core 601 is to be exposed.

Here, there will be explained one example of a manufacturing method of an electronic component relating to the exemplified-embodiment 6.

Step S11

First, the winding wire 602 is assembled on the core portion 612 of the magnetic-body core 601.

Step S12

The non-wound portions 622, 623 of the winding wire 602 are led-around so as to form electrode portions which extend along the side-surface exposed-portions 622*b*, 623*b* and the bottom surface of the magnetic-body core 601. At that time, if necessary, it is allowed to cut off unnecessary portions of the non-wound portions 622, 623.

Step S13

The magnetic-body core 601 and the winding wire 602 which are mutually assembled are arranged in the inside of the mold, an admixture including a magnetic material and a resin is filled into the inside of the mold, and by curing the admixture thereof, the magnetic exterior body 603 is formed.

In this manner, it is possible to manufacture the electronic component relating to the exemplified-embodiment 6.

Then, when the electronic component relating to the exemplified-embodiment 6 is surface-mounted on a substrate, the non-wound portions 622, 623 which are arranged on the bottom surface are soldered on the substrate and solder fillets are formed at the side-surface exposed-portions 622*b*, 623*b*.

As described above, according to the aforesaid exemplified-embodiment 6, the non-wound portions 622, 623 of the winding wire 602 form the side-surface exposed-portions 622*b*, 623*b* on the two facing side surfaces of the aforesaid electronic component. Thus, it is possible to confirm the solder fillets on the two side surfaces without using electrode members which will be formed as separate members.

Exemplified—Embodiment 7

Figure 19:
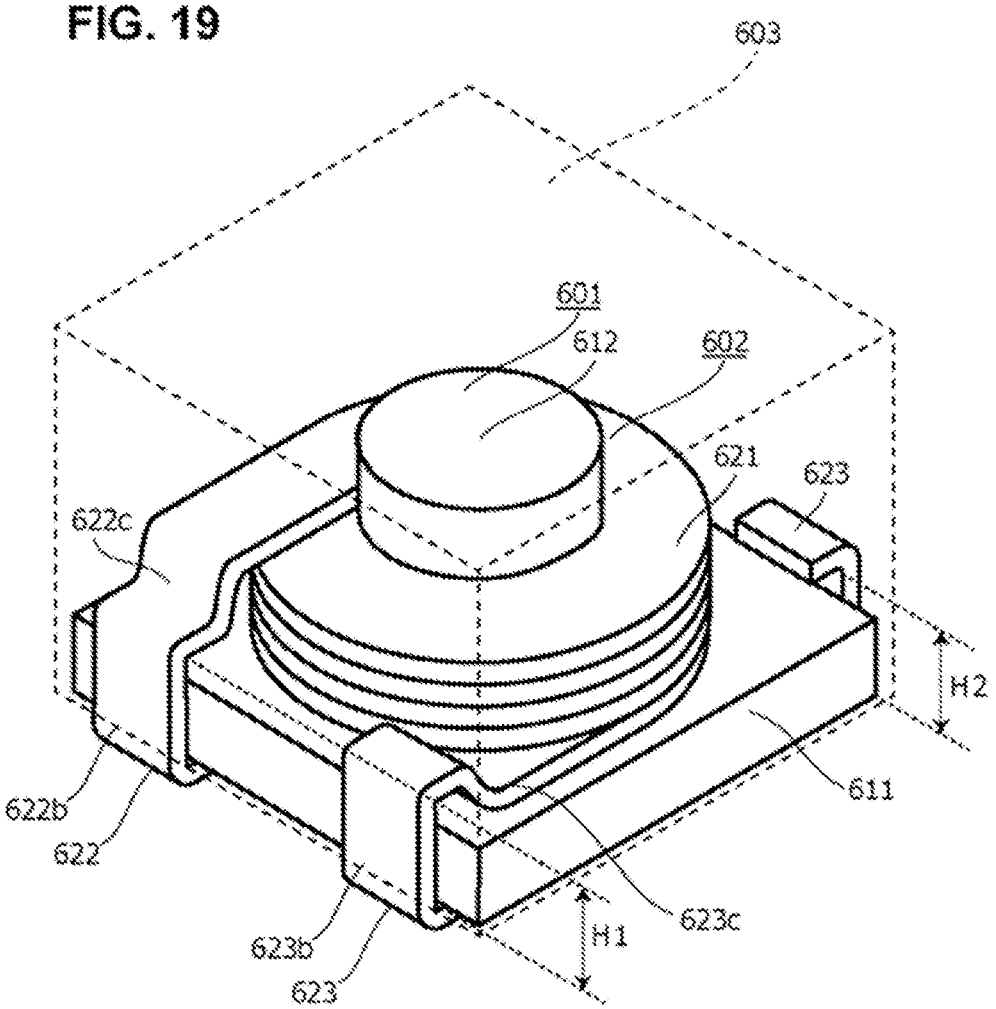
FIG. 19 is a perspective view showing a magnetic-body core and a winding wire in an electronic component relating to an exemplified-embodiment 7 of the present invention.

FIG. 19 is a perspective view showing a magnetic-body core and a winding wire in an electronic component relating to an exemplified-embodiment 7 of the present invention. The electronic component relating to the exemplified-embodiment 7 of the present invention has similar constitutions as those of the electronic component relating to the exemplified-embodiment 6, but has different constitutions in the following aspects.

In the exemplified-embodiment 7, at least one (here, both) of the non-winding wire portions 622, 623 have step portions 622*c*, 623*c* between the winding wire portion 621 and the side surface of the magnetic exterior body 603, and owing to the step portions 622*c*, 623*c* thereof, the heights H1 of the side-surface exposed-portions 622*b*, 623*b* at the side surface thereof are designed to be identical to each other.

In addition, in this exemplified-embodiment, the heights H1 of the side-surface exposed-portions 622*b*, 623*b* at one side surface and the heights H2 of the side-surface exposed-portions 622*b*, 623*b* at the other side surface are designed to be the same.

It should be noted that other constitutions of the electronic component relating to the exemplified-embodiment 7 are similar as those of the exemplified-embodiment 6 and therefore, explanations thereof are omitted. In addition, it is possible to manufacture the electronic component relating to the exemplified-embodiment 7 by similar procedures as those in the manufacturing method of the electronic component relating to the exemplified-embodiment 6.

Exemplified—Embodiment 8

Figure 20:
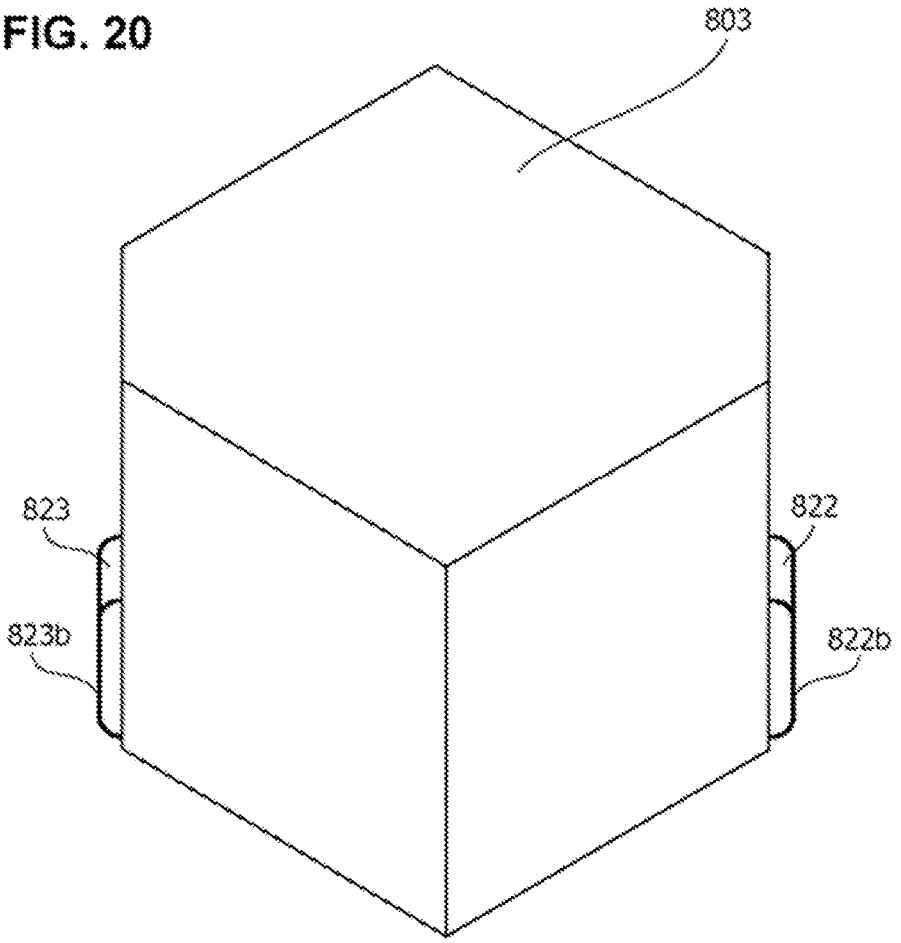
FIG. 20 is a perspective view showing an electronic component relating to an exemplified-embodiment 8 of the present invention.
Figure 21:
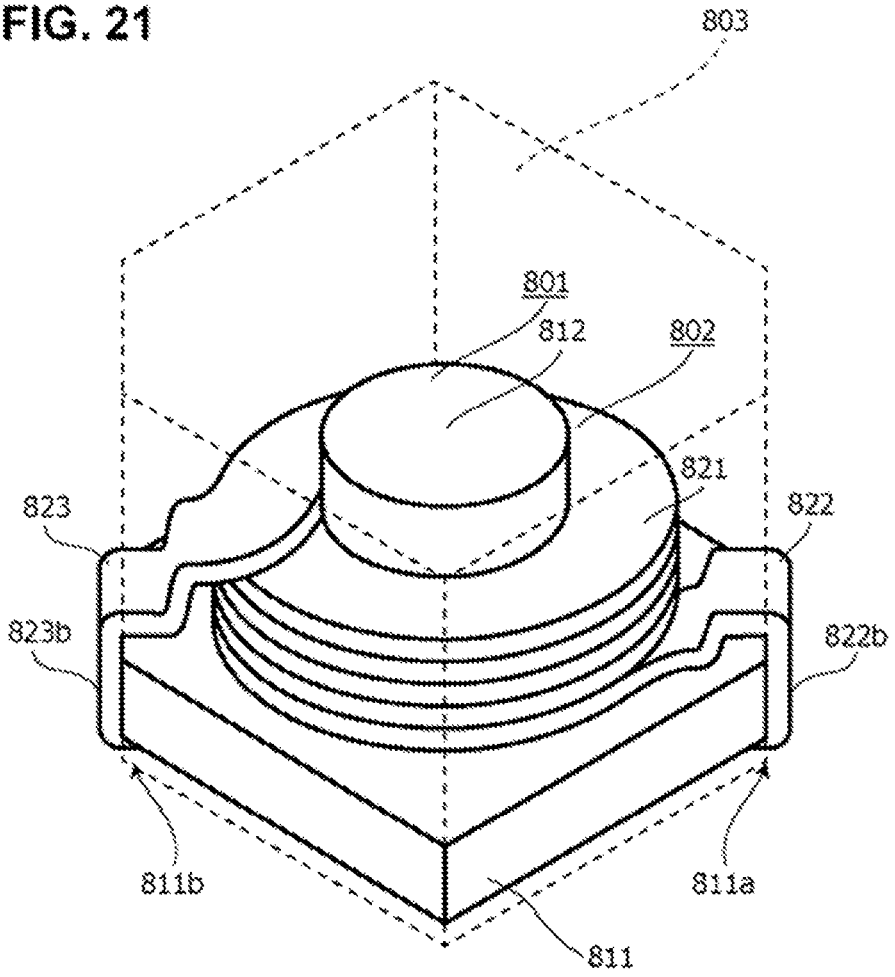
FIG. 21 is a perspective view showing a magnetic-body core and a winding wire in the electronic component relating to the exemplified-embodiment 8 of the present invention (First-Aspect thereof)
Figure 22:
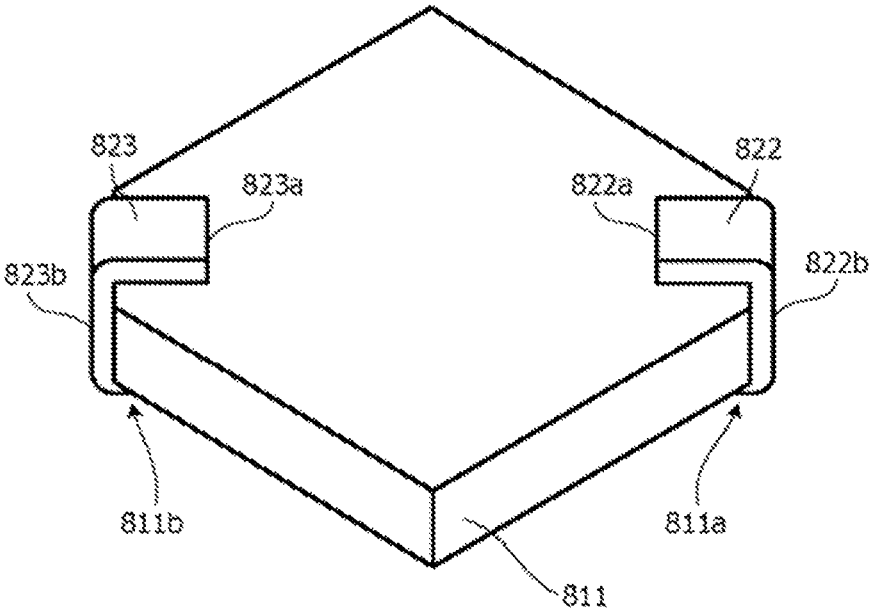
FIG. 22 is a perspective view showing a magnetic-body core and a winding wire in the electronic component relating to the exemplified-embodiment 8 of the present invention (Second-Aspect thereof)

FIG. 20 is a perspective view showing an electronic component relating to an exemplified-embodiment 8 of the present invention. FIG. 21 is a perspective view showing a magnetic-body core and a winding wire in the electronic component relating to the exemplified-embodiment 8 of the present invention (First-Aspect thereof). FIG. 22 is a perspective view showing a magnetic-body core and a winding wire in the electronic component relating to the exemplified-embodiment 8 of the present invention (Second-Aspect thereof).

The electronic component shown in FIGS. 20 to 22 is an inductor and includes a magnetic-body core 801, a winding wire 802 and a magnetic exterior body 803.

The magnetic-body core 801 includes a plate-shaped portion 811 having a substantially cubic shape and a core portion 812 having a substantially cylindrical shape which extends upward from the upper surface of the plate-shaped portion 811. It should be noted that it is allowed for the plate-shaped portion 811 and the core portion 812 to be formed integrally as a T-type core or to be formed as separate bodies which are combined together to form a T-shape one, for example, by an adhesive agent or through an engagement structure.

Then, at the two corners facing each other on a diagonal line of the plate-shaped portion 811, there are formed corner cutoff portions 811*a*, 811*b* which are cut-off by a predetermined angle (for example, by 45 degrees).

The winding wire 802 includes a wound portion 821 wound by a rectangular wire into an Edgewise winding form and two non-wound portions 822, 823 from the wound portion 821 up to two distal ends 822*a*, 823*a* thereof. As shown in FIG. 21, the core portion 812 of the magnetic-body core 801 is inserted through the wound portion 821.

For the wound portion 821, the rectangular wire is wound into an Edgewise winding form in which the layers are laminated in a spiral shape along the winding axis.

As shown in FIG. 21, the non-wound portions 822, 823 are bent toward the Edgewise directions and are pulled out toward the mutually-opposite directions (directions different by approximately 180 degrees) centered on the winding axis.

The non-wound portion 822 is arranged along the corner cutoff portion 811*a* as a side surface of the plate-shaped portion 811 of the magnetic-body core 801 and along the bottom surface, and the non-wound portion 823 is arranged along the corner cutoff portion 811*b* as a side surface of the plate-shaped portion 811 of the magnetic-body core 801 and along the bottom surface. The non-wound portions 822, 823 are fixed on the magnetic-body core 801, for example, by using an adhesive agent.

As shown in FIGS. 20 to 22, while being exposed from the magnetic exterior body 803, the two non-wound portions 822, 823 are bent so as to go along the side surfaces (corner cutoff portions 811*a*, 811*b*) of the aforesaid electronic component.

Within the non-wound portions 822, 823, the portions which are arranged along the bottom surface are used as electrode portions and the portions which are arranged along the corner cutoff portions 811*a*, 811*b* are used as side-surface exposed-portions 822*b*, 823*b*.

In addition, the magnetic exterior body 803 is a body obtained by molding an admixture including a magnetic material (magnetic-powder body such as ferrite, metal magnetic body or the like) and a resin by a predetermined molding method so as to cover at least the wound portion 621 and the core portion 612.

In the exemplified-embodiment 8, as shown in FIGS. 20 to 22, the magnetic exterior body 803 is formed so as to completely cover the wound portion 821 of the winding wire 802, the core portion 812 of the magnetic-body core 801, and the upper surface and the side surfaces (including corner cutoff portions 811*a*, 811*b*) of the plate-shaped portion 811. Therefore, also the magnetic exterior body 803 has corner cut-off shapes in conformity with the corner cutoff portions 811*a*, 811*b*.

It should be noted that it is allowed to employ a configuration in which the magnetic exterior body 803 is to be formed without covering the side surfaces (including corner cutoff portions 811*a*, 811*b*) of the magnetic-body core 801. In addition, it is also allowed to employ a configuration in which the magnetic exterior body 803 is formed such that the lower end of the magnetic exterior body 803 will be positioned at a predetermined position in the height direction of the side surface of the magnetic-body core 801 and in which only a portion of the side surfaces of the magnetic-body core 801 is to be exposed.

It should be noted that it is possible to manufacture the electronic component relating to the exemplified-embodiment 8 by similar procedures as those in the manufacturing method of the electronic component relating to the exemplified-embodiment 6. However, with regard to the electronic component relating to the exemplified-embodiment 8, the non-wound portions 822, 823 are fixed on the bottom surface of the magnetic-body core 801 by an adhesive agent or the like.

Then, when the electronic component relating to the exemplified-embodiment 8 is surface-mounted on a substrate, the non-wound portions 822, 823 which are arranged on the bottom surface are soldered on the substrate and solder fillets are formed at the side-surface exposed-portions 822*b*, 823*b*.

As described above, according to the aforesaid exemplified-embodiment 8, the non-wound portions 622, 623 of the winding wire 602 extend along the facing corner cutoff portions 811*a*, 811*b* of the plate-shaped portion 811 of the magnetic-body core 801, and the side-surface exposed-portions 822*b*, 823*b* are formed at the two facing corners of the aforesaid electronic component. Thus, it is possible to confirm the solder fillets at the two corners of the aforesaid electronic component without using electrode members which will be formed as separate members.

Exemplified—Embodiment 9

Figure 23:
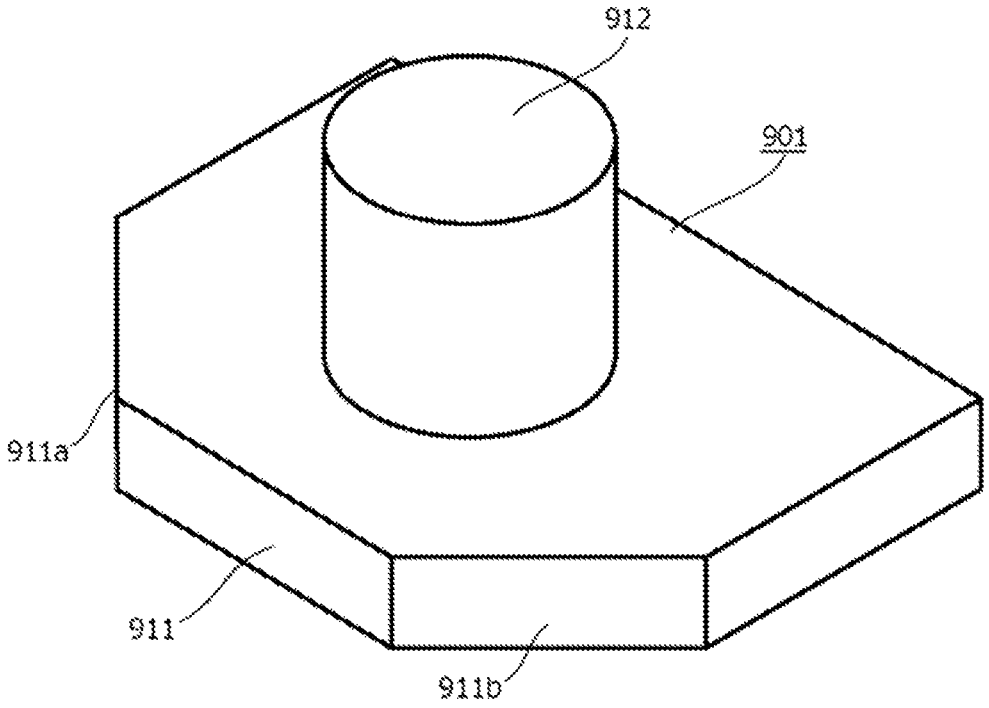
FIG. 23 is a perspective view showing a magnetic-body core in an electronic component relating to an exemplified-embodiment 9 of the present invention.
Figure 24:
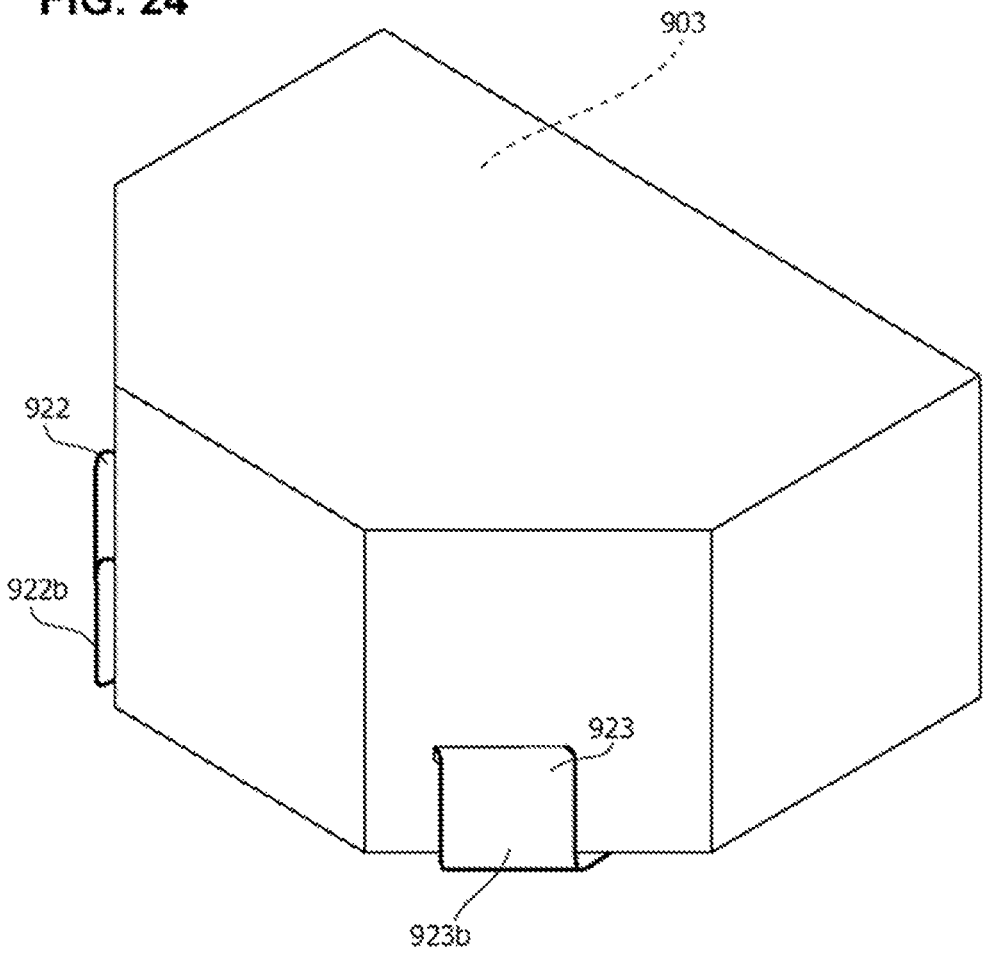
FIG. 24 is a perspective view showing the electronic component relating to the exemplified-embodiment 9 of the present invention.
Figure 25:
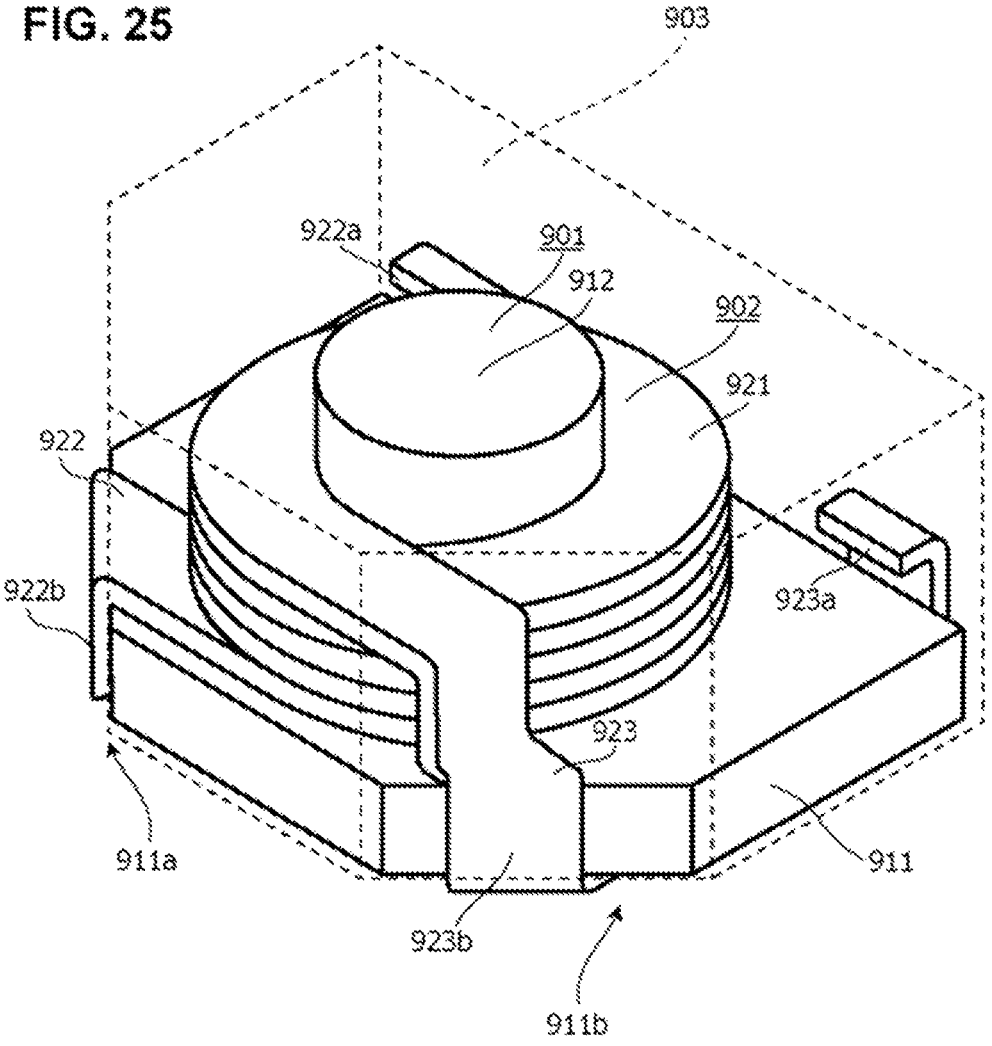
FIG. 25 is a perspective view showing a magnetic-body core and a winding wire in the electronic component relating to the exemplified-embodiment 9 of the present invention (First-Aspect thereof)
Figure 26:
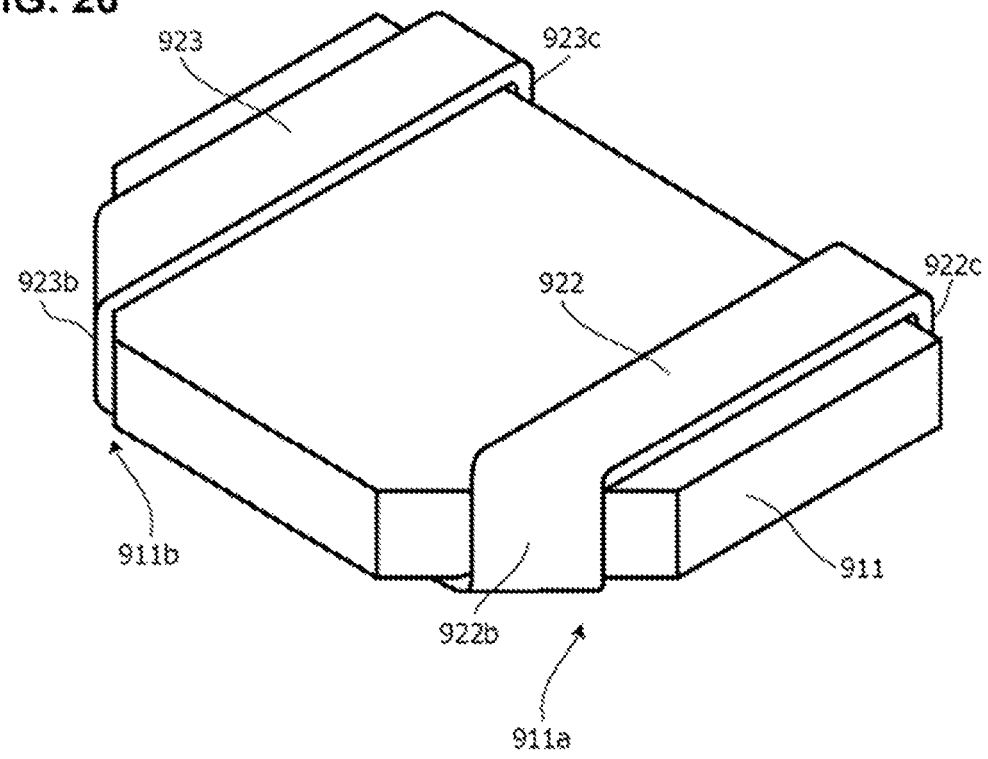
FIG. 26 is a perspective view showing a magnetic-body core and a winding wire in the electronic component relating to the exemplified-embodiment 9 of the present invention (Second-Aspect thereof)

FIG. 23 is a perspective view showing a magnetic-body core in an electronic component relating to an exemplified-embodiment 9 of the present invention. FIG. 24 is a perspective view showing the electronic component relating to the exemplified-embodiment 9 of the present invention. FIG. 25 is a perspective view showing a magnetic-body core and a winding wire in the electronic component relating to the exemplified-embodiment 9 of the present invention (First-Aspect thereof). FIG. 26 is a perspective view showing a magnetic-body core and a winding wire in the electronic component relating to the exemplified-embodiment 9 of the present invention (Second-Aspect thereof).

The electronic component shown in FIGS. 23 to 26 is an inductor and includes a magnetic-body core 901, a winding wire 902 and a magnetic exterior body 903.

The magnetic-body core 901 includes a plate-shaped portion 911 having a substantially rectangular-parallelepiped shape and a core portion 912 having a substantially cylindrical shape which extends upward from the upper surface of the plate-shaped portion 911. It should be noted that it is allowed for the plate-shaped portion 911 and the core portion 912 to be formed integrally as a T-type core or to be formed as separate bodies which are combined together to form a T-shape one, for example, by an adhesive agent or through an engagement structure.

Then, as shown in FIG. 23, at the mutually adjacent two corner portions of the plate-shaped portion 911, there are formed corner cutoff portions 911*a*, 911*b* which are cut-off by a predetermined angle (for example, by 45 degrees).

The winding wire 902 has a wound portion 921 wound by a rectangular wire into an Edgewise winding form and two non-wound portions 922, 923 from the wound portion 921 up to two distal ends 922*a*, 923*a* thereof. As shown in FIG. 25, the core portion 912 of the magnetic-body core 901 is inserted through the wound portion 921.

For the wound portion 921, the rectangular wire is wound into an Edgewise winding form in which the layers are laminated in a spiral shape along the winding axis.

The non-wound portion 922 is arranged along the corner cutoff portion 911*a* as a side surface of the plate-shaped portion 911 of the magnetic-body core 901 and along the bottom surface, and the non-wound portion 923 is arranged along the corner cutoff portion 911*b* as a side surface of the plate-shaped portion 911 of the magnetic-body core 901 and along the bottom surface. As shown in FIG. 26, on the bottom surface, the non-wound portions 922, 923 are arranged approximately in parallel with each other. The non-wound portions 922, 923 are fixed on the magnetic-body core 901, for example, by using an adhesive agent.

As shown in FIGS. 25 and 26, while being exposed from the magnetic exterior body 903, the two non-wound portions 922, 923 are bent so as to go along the side surfaces (corner cutoff portions 911*a*, 911*b*) of the aforesaid electronic component.

Within the non-wound portions 922, 923, the portions which are arranged along the bottom surface are used as electrode portions and the portions which are arranged along the corner cutoff portions 911*a*, 911*b* are used as side-surface exposed-portions 922*b*, 923*b*. Further, as shown in FIGS. 25 and 26, while being exposed from the magnetic exterior body 903, the two non-wound portions 922, 923 are bent so as to go along the facing side surfaces of the aforesaid electronic component in which there exist the corner cutoff portions 911*a*, 911*b*. Then, distal ends 922*a*, 923*a* of the two non-wound portions 922, 923 are positioned in the inside of the magnetic exterior body 903 and sealed in and fixed at the magnetic exterior body 903. Thus, for the side surface facing the side surfaces at which the corner cutoff portions 911*a*, 911*b* exist, side-surface exposed-portions 922c, 923c are formed. Thus, for both of the side surfaces (corner cutoff portions 911a, 911b) on which the side-surface exposed-portions 922b, 923b exist and the side surface on which the side-surface exposed-portions 922c, 923c exist, it is possible to confirm solder fillets. In addition, the distal ends 922a, 923a are sealed in and fixed at the magnetic exterior body 903 and therefore, it is possible to repress the tombstone phenomenon.

In addition, the magnetic exterior body 903 is a body obtained by molding an admixture including a magnetic material (magnetic-powder body such as ferrite, metal magnetic body or the like) and a resin by a predetermined molding method so as to cover at least the wound portion 921 and the core portion 912.

In the exemplified-embodiment 9, as shown in FIGS. 24 and 25, the magnetic exterior body 903 is formed so as to completely cover the wound portion 921 of the winding wire 902, the core portion 912 of the magnetic-body core 901, and the upper surface and the side surfaces (including corner cutoff portions 911a, 911b) of the plate-shaped portion 911.

It should be noted that it is allowed to employ a configuration in which the magnetic exterior body 903 is to be formed without covering the side surfaces (including corner cutoff portions 911a, 911b) of the magnetic-body core 901. In addition, it is also allowed to employ a configuration in which the magnetic exterior body 903 is formed such that the lower end of the magnetic exterior body 903 will be positioned at a predetermined position in the height direction of the side surface of the magnetic-body core 901 and in which only a portion of the side surfaces of the magnetic-body core 901 is to be exposed.

It should be noted that it is possible to manufacture the electronic component relating to the exemplified-embodiment 9 by similar procedures as those in the manufacturing method of the electronic component relating to the exemplified-embodiment 6.

Then, when the electronic component relating to the exemplified-embodiment 9 is surface-mounted on a substrate, the non-wound portions 922, 923 which are arranged on the bottom surface are soldered on the substrate and solder fillets are formed at the side-surface exposed-portions 922b, 923b and side-surface exposed-portions 922c, 923c.

Figure 27:
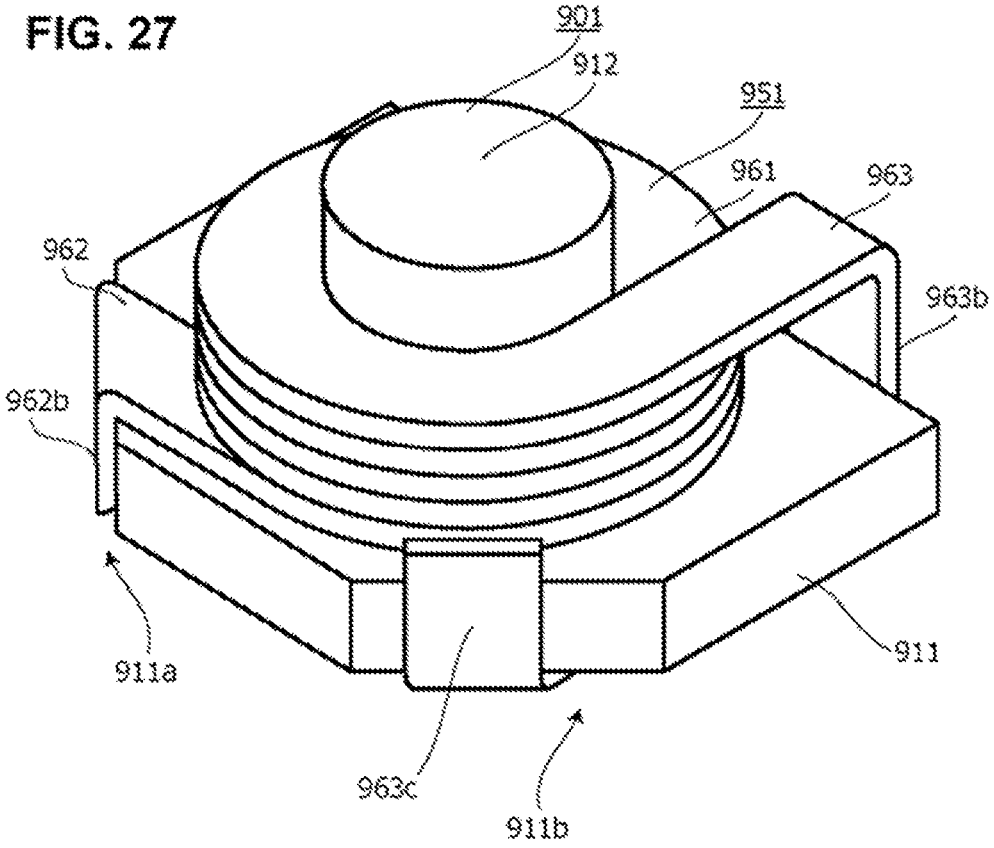
FIG. 27 is a perspective view showing a modified example of the winding wire in the electronic component relating to the exemplified-embodiment 9 of the present invention.

FIG. 27 is a perspective view showing a modified example of the winding wire in the electronic component relating to the exemplified-embodiment 9 of the present invention.

With regard to the winding wire 902 shown in FIG. 26, the non-winding wire portions 922, 923 extend toward the directions approximately 180 degrees different from each other, but with regard to the winding wire 951 shown in FIG. 27, the non-wound portions 962, 963 extending from the wound portion 961 extend toward the directions approximately 90 degrees different from each other. For this reason, the one non-wound portion 963 is arranged so as to extend toward the bottom surface along a side surface which is different from the corner cutoff portions 911a, 911b. With regard to the non-wound portion 963, the portion extending along the side surface is exposed from the magnetic exterior body 903 and is used as a side-surface exposed-portion 963b. The other non-wound portion 962 is arranged similarly as the abovementioned non-winding wire portion 922 and the portion extending along the corner cutoff portion 911a is used as a side-surface exposed-portion 962b. Therefore, also in the case shown in FIG. 27, the non-winding wire portions 962, 963 are arranged approximately in parallel with each other for the bottom surface. Further, the non-wound portion 963 which is used for the side-surface exposed-portion 963b is bent at the edge between the bottom surface and the corner cutoff portion 911b of the magnetic-body core 901 and extends along the corner cutoff portion 911b, in which for the non-wound portion 963, a portion thereof which extends along the corner cutoff portion 911b is used as a side-surface exposed-portion 963c. Further, it is allowed to employ a configuration in which the distal portion of the non-wound portion 963 is bent toward the core portion 912 of the magnetic-body core 901 and the distal end of the non-wound portion 963 is sealed in and fixed at the magnetic exterior body 903.

As described above, according to the aforesaid exemplified-embodiment 9, the non-wound portions 922, 923 of the winding wire 902 extend along the corner cutoff portions 911a, 911b of the plate-shaped portion 911 of the magnetic-body core 901, and the side-surface exposed-portions 922b, 923b are formed at the two facing corners of the aforesaid electronic component. Thus, it is possible to confirm the solder fillets at the two corners without using electrode members which will be formed as separate members.

In addition, according to the aforesaid exemplified-embodiment 9, it is possible to fine-adjust the number of turns of the winding wire 902 by ¼-turn at the magnetic-body core 901 having one shape as shown in FIGS. 25 and 27.

Exemplified—Embodiment 10

Figure 28:
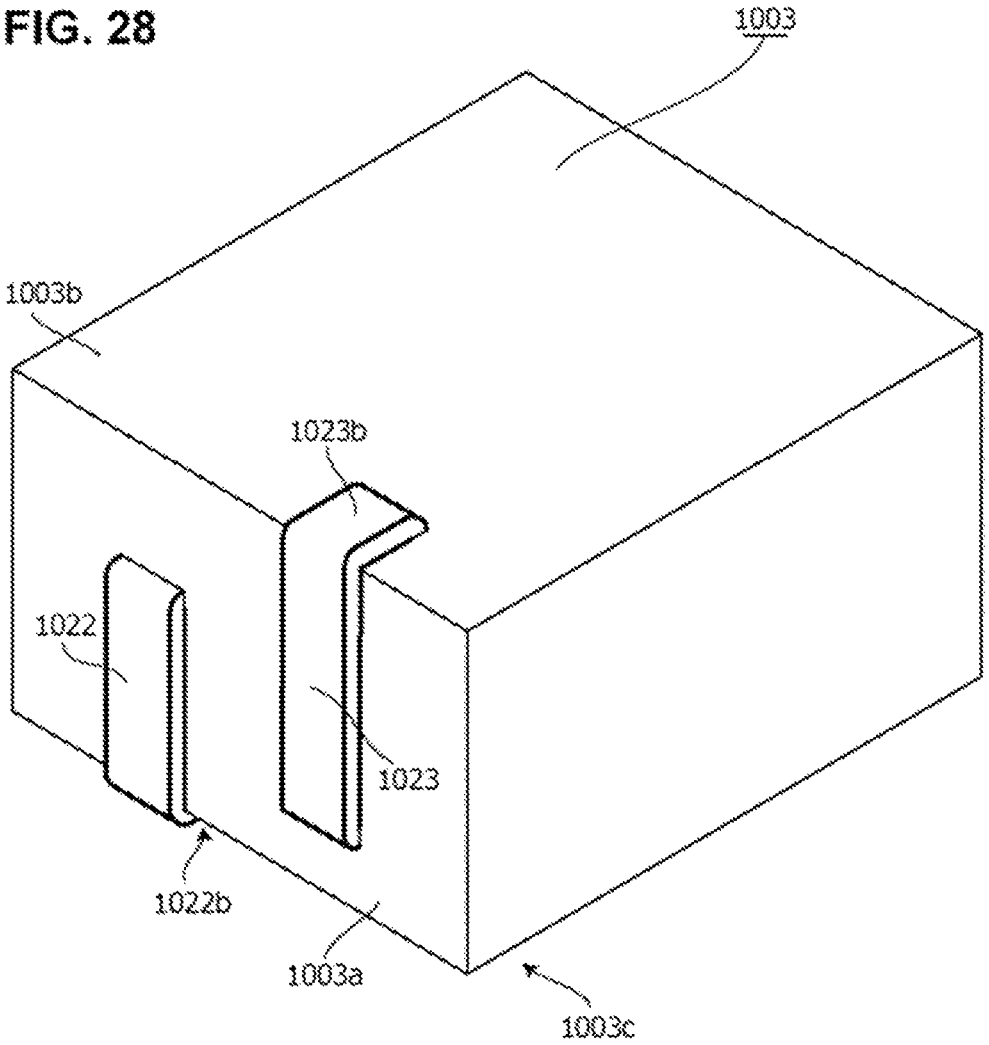
FIG. 28 is a perspective view showing an electronic component relating to an exemplified-embodiment 10 of the present invention.
Figure 29:
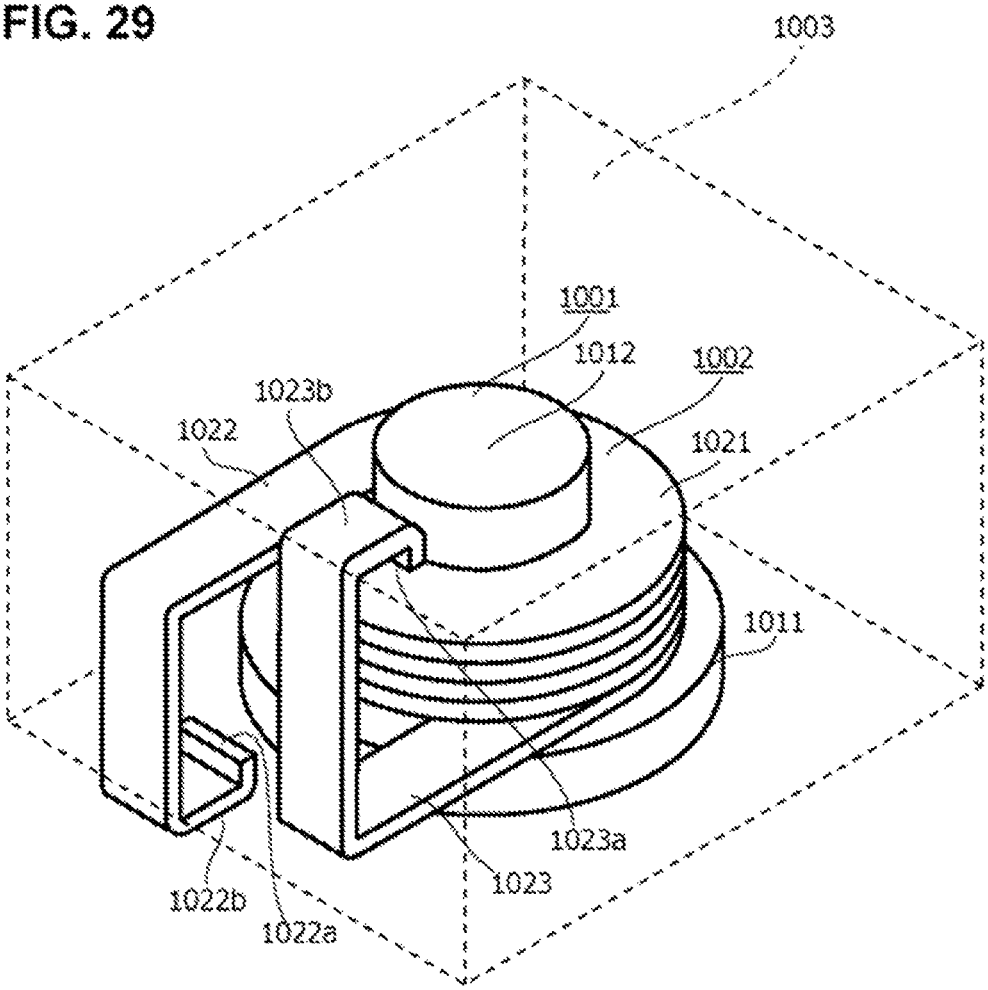
FIG. 29 is a perspective view showing a magnetic-body core and a winding wire in the electronic component relating to the exemplified-embodiment 10 of the present invention.

FIG. 28 is a perspective view showing an electronic component relating to an exemplified-embodiment 10 of the present invention. FIG. 29 is a perspective view showing a magnetic-body core and a winding wire in the electronic component relating to the exemplified-embodiment 10 of the present invention.

The electronic component shown in FIGS. 28 and 29 is an inductor and includes a magnetic-body core 1001, a winding wire 1002, and a magnetic exterior body 1003.

The magnetic-body core 1001 includes a plate-shaped portion 1011 having a substantially cylindrical shape, and a core portion 1012 having a substantially cylindrical shape which extends upward from the upper surface of the plate-shaped portion 1011. It should be noted that it is allowed for the plate-shaped portion 1011 and the core portion 1012 to be formed integrally as a T-type core, or to be formed as separate bodies which are combined together to form a T-shape one, for example, by an adhesive agent or through an engagement structure.

The mounting face of the electronic component relating to this exemplified-embodiment is selected to be a surface 1003a and the core portion 1012 of the magnetic-body core 1001 is arranged approximately in parallel with respect to the mounting face.

The winding wire 1002 includes a wound portion 1021 wound by the rectangular wire into an Edgewise winding form, two non-wound portions 1022, 1023 from the wound portion 1021 up to two distal ends 1022a, 1023a thereof. As shown in FIG. 29, the core portion 1012 of the magnetic-body core 1001 is inserted through the wound portion 1021.

For the wound portion 1021, a rectangular wire is wound into an Edgewise winding form in which the layers are laminated in a spiral shape along the winding axis.

The non-wound portions 1022, 1023 mutually extend approximately in parallel toward a direction perpendicular with respect to the side surface of the magnetic-body core 1001, are bent and extend along the surface 1003a (that is, the bottom surface of the aforesaid electronic component) of the magnetic exterior body 1003.

Further, the non-wound portions 1022, 1023 are bent at the edge portions of the magnetic exterior body 1003 respectively and extend along the surfaces 1003*b*, 1003*c* (that is, side surfaces of the aforesaid electronic component). Further, the non-wound portions 1022, 1023 are bent, and the distal ends 1022*a*, 1023*a* thereof are positioned in the inside of the magnetic exterior body 1003 and are sealed in and fixed at the magnetic exterior body 1003.

As shown in FIG. 28, while being exposed from the magnetic exterior body 1003, the two non-wound portions 1022, 1023 are bent so as to go along the side surface of the aforesaid electronic component. In this manner, within the non-wound portions 1022, 1023, portions which are arranged along the bottom surface are used as electrode portions and portions which are arranged along the side surface are used as side-surface exposed-portions 1022*b*, 1023*b*.

In addition, the magnetic exterior body 1003 is a body obtained by molding an admixture including a magnetic material (magnetic-powder body such as ferrite, metal magnetic body or the like) and a resin by a predetermined molding method so as to cover at least the wound portion 1021 and the core portion 1012.

In the exemplified-embodiment 10, as shown in FIGS. 28 and 29, the magnetic exterior body 1003 is formed so as to completely cover the wound portion 1021 of the winding wire 1002, and the core portion 1012 and the plate-shaped portion 1011 of the magnetic-body core 1001.

It should be noted that it is possible to manufacture the electronic component relating to the exemplified-embodiment 10 by similar procedures as those in the manufacturing method of the electronic component relating to the exemplified-embodiment 6.

Then, when the electronic component relating to the exemplified-embodiment 10 is surface-mounted on a substrate, the non-wound portions 1022, 1023 which are arranged on the bottom surface are soldered on the substrate and solder fillets are formed at the side-surface exposed-portions 1022*b*, 1023*b*.

As described above, according to the aforesaid exemplified-embodiment 10, the non-wound portions 1022, 1023 of the winding wire 1002 are mutually pulled out approximately in parallel toward the bottom surface (that is, the mounting face) of the aforesaid electronic component, are bent toward mutually opposite directions, are arranged along the bottom surface, are further bent, and are arranged along the side surface. Therefore, even in a case in which the core portion 1012 of the magnetic-body core 1001 is arranged approximately in parallel with the bottom surface of the aforesaid electronic component, it is possible to confirm the solder fillets on the facing two side surfaces of the aforesaid electronic component without using electrode members which will be formed as separate members.

Exemplified—Embodiment 11

Figure 30:
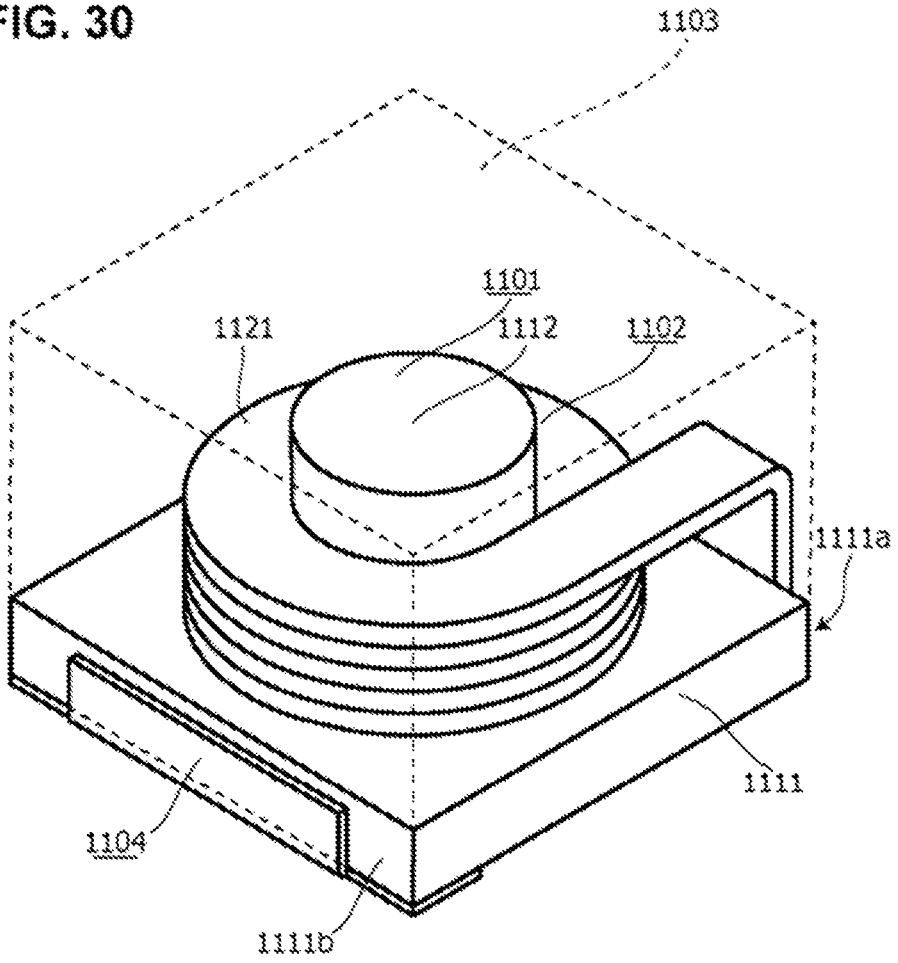
FIG. 30 is a perspective view showing a magnetic-body core and a winding wire in an electronic component relating to an exemplified-embodiment 11 of the present invention.
Figure 31:
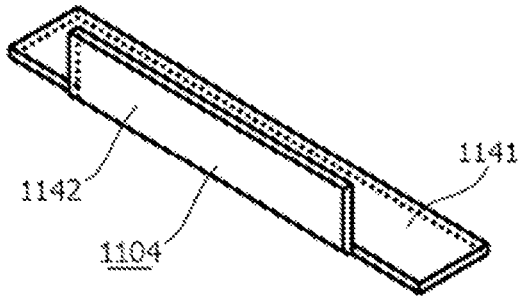
FIG. 31 is a perspective view showing one example of a pseudo electrode member in FIG. 30.

FIG. 30 is a perspective view showing a magnetic-body core and a winding wire in an electronic component relating to an exemplified-embodiment 11 of the present invention. FIG. 31 is a perspective view showing one example of a pseudo electrode member in FIG. 30.

The electronic component shown in FIG. 30 is an inductor and includes a magnetic-body core 1101, a winding wire 1102, a magnetic exterior body 1103 and a pseudo electrode member 1104.

The magnetic-body core 1101 is the same magnetic-body core as the abovementioned magnetic-body core 601.

In addition, similarly as the abovementioned magnetic exterior body 603, the magnetic exterior body 1103 is a body obtained by molding an admixture including a magnetic material (magnetic-powder body such as ferrite, metal magnetic body or the like) and a resin by a predetermined molding method so as to cover at least the wound portion 1121 and the core portion 1112.

In addition, similarly as the abovementioned winding wire 602, the winding wire 1102 includes a wound portion 1121 wound by a rectangular wire into an Edgewise winding form and two non-wound portions from the wound portion 1121 up to two distal ends thereof. In addition, as shown in FIG. 30, the core portion 1112 of the magnetic-body core 1101 is inserted through the wound portion 1121.

Both of these two non-wound portions are arranged approximately in parallel with each other along a side surface 1111*a* and a bottom surface of a plate-shaped portion 1111 of the magnetic-body core 1101. In this exemplified-embodiment, the two non-wound portions are formed so as to be extended in the same direction. While being exposed, the two non-wound portions are extended from a magnetic exterior body 1103 along one side surface 1111*a* and the bottom surface of the magnetic-body core 1101, but they are not exposed from a side surface 1111*b* facing the side surface 1111*a*. Therefore, in this exemplified-embodiment, the non-wound portions of the winding wire 1102 are fixed on the bottom surface of the magnetic-body core 1101, for example, by an adhesive material.

Therefore, similarly as the exemplified-embodiment 6, the non-wound portions of the winding wire 1102 are used as electrode portions and as side-surface exposed-portions for the one side surface 1111*a*.

Further, on the side surface 1111*b* which faces the side surface at which the side-surface exposed-portions formed by the non-wound portions of the winding wire 1102 are positioned, the pseudo electrode member 1104 is fixed on the magnetic-body core 1101, for example, by an adhesive agent.

As shown in FIG. 31, the pseudo electrode member 1104 includes a pseudo electrode portion 1141 having a flat-plate shape and a side-surface exposed-portion 1142 which is extended by being stood upright from the pseudo electrode portion 1141. The pseudo electrode portion 1141 and the side-surface exposed-portion 1142 are exposed from the magnetic exterior body 1103.

The pseudo electrode portion 1141 is not connected to the winding wire 1102 electrically, but it is connected to the substrate at the time of the surface mounting. For this reason, solder fillets are formed also at the side-surface exposed-portion 1142 together with the side-surface exposed-portions formed by the non-wound portions of the winding wire 1102.

It should be noted that it is possible to manufacture the electronic component relating to the exemplified-embodiment 11 by similar procedures as those in the manufacturing method of the electronic component relating to the exemplified-embodiment 6. However, before forming the magnetic exterior body 1103, the pseudo electrode portion 1141 is fixed on the magnetic-body core 1101.

As described above, according to the aforesaid exemplified-embodiment 11, there is installed the pseudo electrode member 1104 on the side surface facing the side surface on which the side-surface exposed-portion is formed by the winding wire 1102. Thus, it is possible to repress the occurrence of the tombstone phenomenon when mounting the aforesaid electronic component and concurrently, it is possible to confirm the solder fillets on the two facing side surfaces.

It should be noted that the abovementioned respective exemplified-embodiments are preferable examples of the present invention, but the present invention is not to be limited by these examples and it is possible to employ various modifications and changes within the scope of the present invention without departing from the gist thereof.

For example, it is allowed for the magnetic-body core in the abovementioned exemplified-embodiments 1 to 11 to employ a ferrite core or a powder-compacted core in which metal magnetic powders are compression-molded. In that case, particularly, for magnetic powders of the powder-compacted core, the magnetic powders of which main component is iron and on which silicone (Si) and chromium (Cr) are added by 1 wt % to 10 wt % respectively are preferable for usage because they are excellent in the aspect of the rust preventive property, the relative permeability or the like. In that case, for the magnetic powders of the powder-compacted core particularly, it is preferable for the utilization thereof to employ magnetic powders which includes iron as the main component thereof and which is added with silicone (Si) and chromium (Cr) as much as 1 wt % to 10 wt % respectively, because such powders are excellent in an aspect of rust preventive property, relative permeability or the like.

In addition, for example, for the rectangular wire used for the winding wire in the abovementioned exemplified-embodiments 1 to 11, there is used a wire having an insulating coating, in which the insulating coating on the electrode portion in the exemplified-embodiments 6 to 11, the connecting portion with respect to the electrode member in the exemplified-embodiments 1 to 5 and the like are peeled off if necessary. It should be noted that in case of peeling off the insulating coating of the electrode portion, only the insulating coating on one surface, that is, the surface facing the substrate of the rectangular wire at the time of the mounting thereof is peeled off and with regard to the opposite surface which faces the magnetic-body core, the insulating coating thereof is not peeled off. By doing in this manner, in the winding wire, it becomes difficult for the peeled-off portion to be in contact with the magnetic exterior body and the insulation property between the winding wire and the magnetic exterior body becomes excellent. However, in a case in which the insulation properties of the magnetic-body core and the magnetic exterior body are excellent, it is allowed for the insulating coating to be peeled off as far as the above-mentioned distal end side and in addition, it is allowed for the insulating coating on the side facing the magnetic-body core to be peeled off.

In addition, for example, for the magnetic exterior body in the abovementioned exemplified-embodiments 1 to 11, there is used the same metal magnetic-powder body as that of the corresponding magnetic-body core. It should be noted that in order to adjust the electromagnetic property, it is allowed, if necessary, to change the amount of the magnetic powders or the material to be used in the inside the magnetic exterior body.

In addition, for the method of forming the magnetic exterior body in the abovementioned exemplified-embodiments 1 to 11, there are used such a method in which: (a1) a magnetic-body core attached with a winding wire is arranged in the inside of a mold, (a2) the inside of the mold is filled with a slurry-state admixture including a magnetic material and a resin and (a3) by thermally curing the slurry-state admixture filled in the inside of the mold, a magnetic exterior body is formed; a method in which: (b1) a magnetic-body core attached with a winding wire is arranged in the inside of a mold, (b2) the inside of the mold is filled with a putty-state admixture including a magnetic material and a resin, (b3) by thermally curing the putty-state admixture filled in the inside of the mold, a magnetic exterior body is formed; a method in which: (c1) a magnetic-body core attached with a winding wire is arranged in the inside of a mold, (c2) the inside of the mold is filled with an admixture including a magnetic material and a resin, (c3) the admixture filled in the inside of the mold is compression-molded, (c4) the admixture and the magnetic-body core attached with the winding wire after the compression molding are taken out from the mold and are thermally cured, in which the admixture after the compression molding is made to be a magnetic exterior body; and the like.

In addition, the electronic component relating to the aforesaid exemplified-embodiments 1 to 11 is an inductor, but it is also allowed to employ an element which includes a similar magnetic-body core, a similar winding wire and a similar magnetic exterior body or to employ an electronic component in which other elements are formed together with the magnetic-body core and the winding wire in a single package. Such an electronic component includes also an electronic component, such as, for example, a DC-DC converter, which includes an IC (Integrated Circuit) chip, a capacitor, a circuit board and the like. For example, with regard to the DC-DC converter, the elements such as a magnetic-body core on which there is assembled a winding wire formed by a rectangular wire as mentioned above, an IC chip and the like are mounted on a PCB substrate, in which they are sealed by a magnetic exterior body as mentioned above. At that time, it is possible to use the abovementioned electrode members as the terminals of the DC-DC converter.

In addition, with regard to the electronic component relating to the aforesaid exemplified-embodiments 1 to 11, the core portion of the magnetic-body core is protruded upward from the most upper surface of the wound portion of the winding wire, but it is allowed to form the core portion of the magnetic-body core to be lower than the most upper surface of the wound portion of the winding wire. In addition, it is enough if the height of the core portion of magnetic-body core is set corresponding to the requested inductance value.

In addition, in the aforesaid exemplified-embodiments 1 to 11, a rectangular wire is used for the winding wire, but it is allowed to use a round wire if necessary. In addition, also with regard to the winding methods of the winding wire, they are not limited by the methods described in the aforesaid exemplified-embodiments 1 to 11, and it is possible, with regard to the rectangular wire, to employ such as a Flatwise-winding, an Edgewise winding and the like for the multi layers (two layers, three layers, four layers or the like) appropriately if necessary, and with regard to the round wire, it is possible to employ such as an alignment-winding, an alpha-winding and the like appropriately if necessary. In addition, for the aforesaid exemplified-embodiments 1 to 11, the number of turns of the winding wire is determined corresponding to the inductance value or the like which is requested for the aforesaid electronic component.

In addition, for the aforesaid exemplified-embodiments 6 to 11, it is allowed to employ a configuration in which at the place at which the non-wound portion of the winding wire is arranged for at least one of the side surface and the bottom surface of the magnetic-body core, there is formed a concave portion or a groove having a shape such as that of the abovementioned concave portion 411*a*, 411*b* and the non-wound portion is to be arranged in the inside of the concave portion or the groove thereof. In case of employing such a configuration, the positioning of the non-wound portion becomes easy.

In addition, for the aforesaid exemplified-embodiments 1 to 11, it is allowed to employ a configuration in which the magnetic exterior body covers only a portion of the side surfaces of the plate-shaped portion of the magnetic-body core and at that time, with regard to the electrode members and the winding wire which are used at the abovementioned side-surface exposed-portions, it is allowed to employ such a configuration in which the magnetic exterior body seals only a portion of the plate-shaped portion of the magnetic-body core, the electrode members and the winding wire such that only the portions along the side surfaces of the plate-shaped portion of the magnetic-body core are to be exposed.

Preferred embodiments of the invention are specified in the following paragraphs:

(1) An electronic component which includes a first side-surface and a second side-surface facing the first side-surface, comprising:

a magnetic-body core including a plate-shaped portion and a core portion which extends from the upper surface of the plate-shaped portion;

a winding wire which includes a wound portion wound by a rectangular wire and two non-wound portions from the wound portion up to two distal ends, and of which the core portion is inserted through the wound portion;

a magnetic exterior body which covers at least the wound portion and the core portion;

a first electrode member including a first side-surface exposed-portion which is exposed along the first side-surface; and a second electrode member including a second side-surface exposed-portion which is exposed along the second side-surface, wherein the first side-surface exposed-portion includes a first connecting portion which extends along the height direction of the first side-surface, the first connecting portion is connected to one of the non-wound portions, the second side-surface exposed-portion includes a second connecting portion which extends along the height direction of the second side-surface, and the second connecting portion is connected to the other of the non-wound portions.

(2) An electronic component which includes a first side-surface and a second side-surface facing the first side-surface, comprising:

a magnetic-body core including a plate-shaped portion and a core portion which extends from the upper surface of the plate-shaped portion;

a winding wire which includes a wound portion wound by a rectangular wire and two non-wound portions extending from the wound portion up to two distal ends, and of which the core portion is inserted through the wound portion;

a magnetic exterior body having a substantially rectangular-parallelepiped shape which covers at least the wound portion and the core portion;

a first electrode member including a first side-surface exposed-portion which is exposed along the first side-surface; and a second electrode member including a second side-surface exposed-portion which is exposed along the second side-surface, wherein the first electrode member includes a first connecting portion extending in the height direction of the electronic component inside at any corner within the four corners of the bottom surface of the magnetic exterior body, the first connecting portion is connected to one of the non-wound portions, the second electrode member includes a second connecting portion extending in the height direction of the electronic component inside at another corner within the four corners of the bottom surface of the magnetic exterior body, and the second connecting portion is connected to the other of the non-wound portions.

(3) An electronic component which includes a first side-surface and a second side-surface facing the first side-surface, comprising:

a magnetic-body core including a plate-shaped portion and a core portion which extends from the upper surface of the plate-shaped portion;

a winding wire which includes a wound portion wound by a rectangular wire into an Edgewise winding form and two non-wound portions extending from the wound portion up to two distal ends, and of which the core portion is inserted through the wound portion;

a magnetic exterior body which covers at least the wound portion and the core portion;

a first electrode member including a first side-surface exposed-portion which is exposed along the first side-surface; and a second electrode member including a second side-surface exposed-portion which is exposed along the second side-surface, wherein the first electrode member is connected to one of the non-wound portions, and the second electrode member is connected to the other of the non-wound portions.

(4) An electronic component which includes a bottom surface, a first side-surface and a second side-surface facing the first side-surface, comprising:

a magnetic-body core including a plate-shaped portion and a core portion which extends from the upper surface of the plate-shaped portion;

a winding wire which includes a wound portion wound by a rectangular wire into an Edgewise winding form and two non-wound portions extending from the wound portion up to two distal ends, and of which the core portion is inserted through the wound portion; and a magnetic exterior body which covers at least the wound portion and the core portion, wherein the two non-wound portions are respectively arranged along at least one of the bottom surface, the first side-surface and the second side-surface, and the portion arranged along the bottom surface at the two non-wound portions is an electrode.

(5) The electronic component according to claim 4, further comprising:

a pseudo electrode member having a side-surface exposed-portion which is exposed along the first side-surface, wherein the two non-wound portions are arranged along the bottom surface and along the second side-surface respectively.

INDUSTRIAL APPLICABILITY

The present invention is applicable, for example, to an electronic component including a magnetic-body core and a winding wire.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. An electronic component comprising:

a magnetic-body core that includes:

a plate-shaped portion having an upper surface, a bottom surface, and a plurality of side surfaces, the plurality of side surfaces including first and second side surfaces, and a core portion extending from the upper surface of the plate-shaped portion;

a winding wire that includes a wound portion wound by a rectangular wire into an Edgewise winding form and first and second non-wound portions, the first and second non-wound portions extending from the wound portion to first and second distal ends, the core portion being inserted through the wound portion; and a magnetic exterior body that covers the wound portion, the core portion, the upper surface of the plate-shaped portion, and the plurality of side surfaces of the plate-shaped portion, wherein the first and second non-wound portions are respectively arranged along the bottom surface and the first and second side surfaces of the plate-shaped portion, a first part of the first non-wound portion and a second part of the second non-wound portion arranged along the bottom surface of the plate-shaped portion are electrodes, third and fourth parts of the first non-wound portion arranged along the first and second side surfaces, respectively, are exteriorly exposed relative to the magnetic exterior body, fifth and sixth parts of the second non-wound portion arranged along the first and second side surfaces, respectively, are exteriorly exposed relative to the magnetic exterior body, exteriorly exposed lengths of the third, fourth, fifth, and sixth parts are the same, and each of the first and second distal ends of the first and second non-wound portions is inwardly bent toward the wound portion, and the first and second distal ends of the first and second non-wound portions are embedded into the magnetic exterior body so that the first and second non-wound portions are fixed to the magnetic exterior body via the embedded first and second distal ends.

2. The electronic component according to claim 1, wherein the plate-shaped portion and the core portion of the magnetic-body core are independent members which are combined together to form the magnetic-body core.

3. The electronic component according to claim 1, wherein the first and second distal ends of the first and second non-wound portions are proximate the second side surface of the plate-shaped portion.

4. The electronic component according to claim 1, wherein each of the first and second non-wound portions has a step between the wound portion and one of a plurality of side surfaces of the magnetic exterior body that is proximate the first side surface of the plate-shaped portion.

5. The electronic component according to claim 1, wherein each of the first and second distal ends of the first and second non-wound portions is bent at a right angle.

6. The electronic component according to claim 3, wherein each of the first and second distal ends of the first and second non-wound portions is bent at a right angle.

7. The electronic component according to claim 4, wherein each of the first and second distal ends of the first and second non-wound portions is bent at a right angle.

8. The electronic component according to claim 3, wherein each of the first and second non-wound portions has a step between the wound portion and one of a plurality of side surfaces of the magnetic exterior body that is proximate the first side surface of the plate-shaped portion.

9. The electronic component according to claim 5, wherein each of the first and second non-wound portions has a step between the wound portion and one of a plurality of side surfaces of the magnetic exterior body that is proximate the first side surface of the plate-shaped portion.

10. The electronic component according to claim 6, wherein each of the first and second non-wound portions has a step between the wound portion and one of a plurality of side surfaces of the magnetic exterior body that is proximate the first side surface of the plate-shaped portion.

11. The electronic component according to claim 1, wherein the first and second side surfaces of the plate-shaped portion are opposite to each other.

12. The electronic component according to claim 3, wherein the first and second side surfaces of the plate-shaped portion are opposite to each other.

13. The electronic component according to claim 4, wherein the first and second side surfaces of the plate-shaped portion are opposite to each other.

14. The electronic component according to claim 5, wherein the first and second side surfaces of the plate-shaped portion are opposite to each other.

15. The electronic component according to claim 6, wherein the first and second side surfaces of the plate-shaped portion are opposite to each other.

16. The electronic component according to claim 7, wherein the first and second side surfaces of the plate-shaped portion are opposite to each other.

17. The electronic component according to claim 8, wherein the first and second side surfaces of the plate-shaped portion are opposite to each other.

18. The electronic component according to claim 9, wherein the first and second side surfaces of the plate-shaped portion are opposite to each other.

19. The electronic component according to claim 10, wherein the first and second side surfaces of the plate-shaped portion are opposite to each other.

* * * * *